US007517048B2

(12) United States Patent
Takagi

(10) Patent No.: US 7,517,048 B2
(45) Date of Patent: Apr. 14, 2009

(54) INK-JET RECORDING APPARATUS

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 368 days.

(21) Appl. No.: 11/138,901

(22) Filed: May 27, 2005

(65) Prior Publication Data

US 2005/0264603 A1 Dec. 1, 2005

(30) Foreign Application Priority Data

May 28, 2004 (JP) ..... 2004-159873

(51) Int. Cl.
*B41J 23/00* (2006.01)
*B41J 2/165* (2006.01)
*B41J 2/18* (2006.01)

(52) U.S. Cl. ..... 347/37; 347/22; 347/32; 347/91

(58) Field of Classification Search ..... 347/37, 347/32, 22, 91
See application file for complete search history.

(56) References Cited

U.S. PATENT DOCUMENTS 5,467,116 A * 11/1995 Nakamura et al. ..... 347/50
5,740,051 A * 4/1998 Sanders et al. ..... 700/119
2001/0012027 A1 8/2001 Murcia et al.
2003/0090535 A1* 5/2003 Park ..... 347/29
2003/0222939 A1* 12/2003 Gompertz ..... 347/43
2004/0017423 A1 1/2004 Wooton et al.

FOREIGN PATENT DOCUMENTS

| | | |
|---|---|---|
| EP | 1457343 A1 | 9/2004 |
| JP | 9-123470 | 5/1997 |
| JP | 9-141880 | 6/1997 |
| JP | 2000-168062 | 6/2000 |

* cited by examiner

*Primary Examiner*—Stephen D Meier
*Assistant Examiner*—Sarah Al-Hashimi
(74) *Attorney, Agent, or Firm*—Banner & Witcoff, Ltd.

(57) ABSTRACT

An ink-jet recording apparatus includes a first carriage, a second carriage, and a carriage-moving mechanism. The first carriage is reciprocally movable in parallel with an ink ejection face of an ink-jet head. The second carriage is separate from the first carriage and reciprocally movable in the same direction as a movement direction of the first carriage. The carriage-moving mechanism selectively moves the first carriage and the second carriage. The first carriage is mounted with at least one of a wiper that wipes off ink adhering to the ink ejection face, a sheet that receives ink ejected from the ink-jet head, a cap that seals the ink ejection face, and a shutter that is disposed to confront and protect the ink ejection face. The second carriage is mounted with at least one of the wiper, the sheet, the carriage, and the shutter except the one(s) mounted on the first carriage.

17 Claims, 29 Drawing Sheets

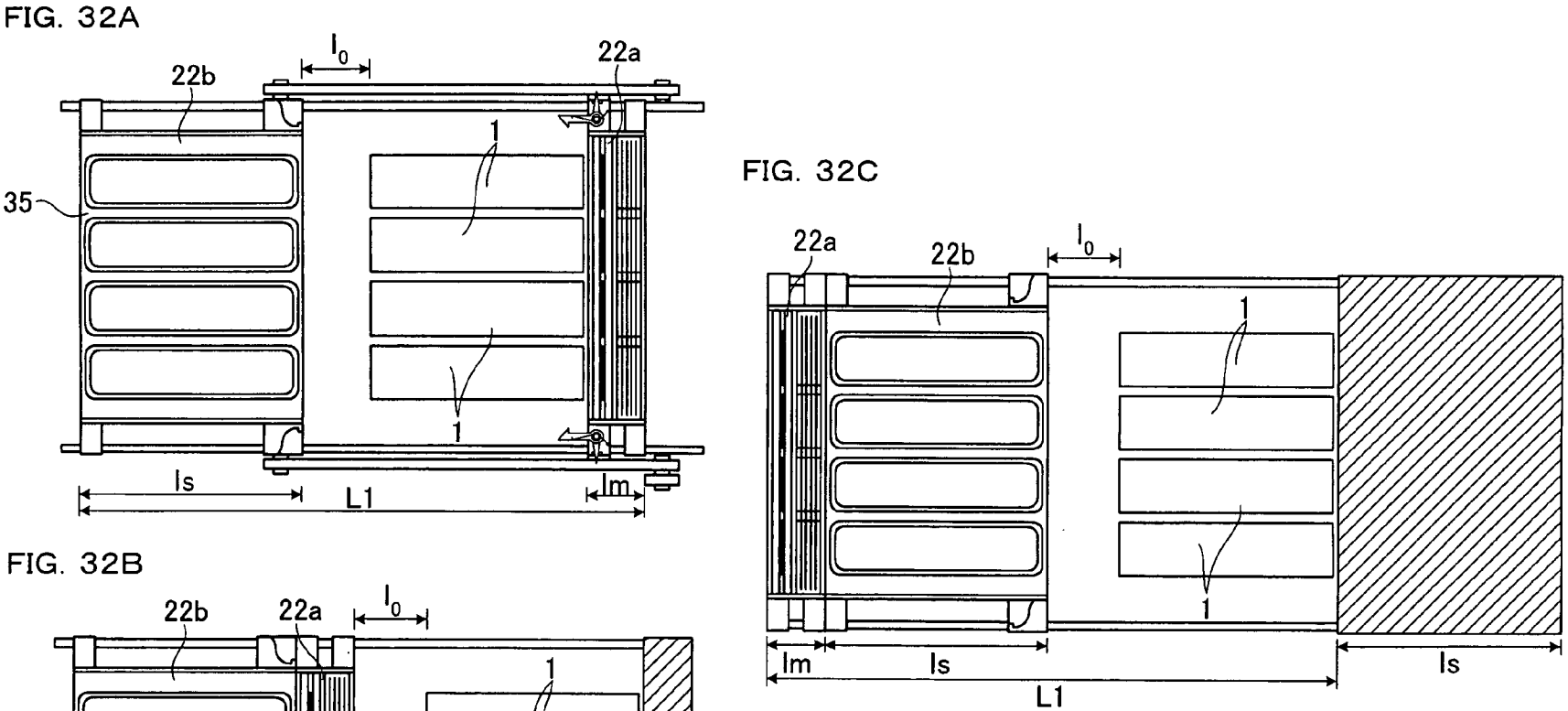
FIG. 32A
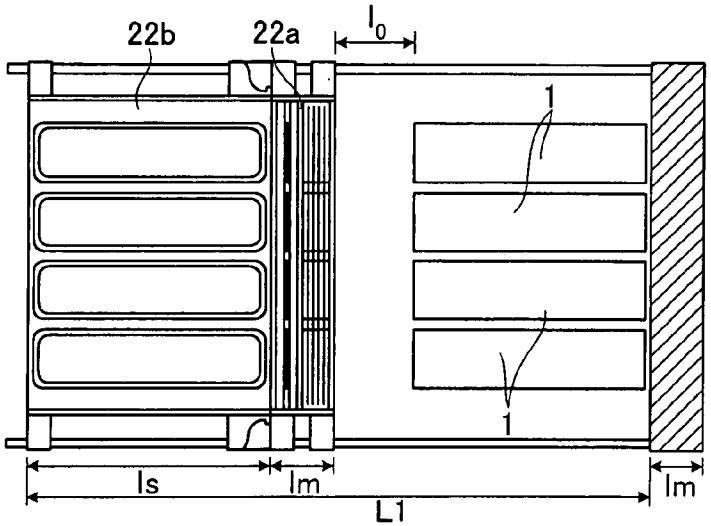
FIG. 32B
FIG. 32C

INK-JET RECORDING APPARATUS

BACKGROUND OF THE INVENTION

1. Field of the Invention

The present invention relates to an ink-jet recording apparatus that ejects ink to a record medium.

2. Description of Related Art

One of known heads of ink-jet recording apparatuses has a large number of nozzles that eject ink, pressure chambers that communicate with the respective nozzles, and actuators that correspond to the respective pressure chambers. When an actuator is driven, a pressure chamber corresponding to this actuator is reduced in volume, so that ink is ejected through a corresponding nozzle. In this type of head, when ink left within the nozzles dries and increases in viscosity or when foreign matters such as dust, air bubbles, etc. are mixed into ink, ink-flow within the head is deteriorated and thus ink ejection may see drawbacks.

In order to maintain or restore good ink ejection performance, one of known techniques adopts head maintenance in which a face of a head having nozzles formed therein (i.e., an ink ejection face of the head) is sealed with a cap (which means a "capping") so that ink left within the nozzles can be prevented from drying up or in which ink having high viscosity or containing foreign matters is forcibly sucked and discharged from the nozzles (which is called a "purge operation"), and the like (see Japanese Patent Unexamined Publication No. 9-123470).

In this technique, two maintenance members, i.e., a cap and an ink suction member, are movable by a moving mechanism that includes rollers disposed to surround the heads in a vertical direction and a looped belt that spans the rollers to circle around the heads. The cap and the ink suction member disposed adjacent to each other are mounted on the belt, so that as the belt travels they move around the heads. When the belt and the rollers, which form a mechanism for moving a maintenance member, are disposed around the heads in the aforementioned manner, a size of the ink-jet recording apparatus with respect to the vertical direction, i.e., a direction perpendicular to the ink ejection face, is increased. In the aforementioned technique, even if the maintenance members do not move around the heads but move straight along a direction parallel to the ink ejection face, the two maintenance members are still mounted on the belt to be adjacent to each other in a longitudinal direction of the belt, and thus a relatively large space with respect to the direction parallel to the ink ejection face is required for these two members (e.g., a space where these two members stay without confronting the ink ejection faces of the heads during a printing operation and a space for movement of the members in head maintenance). In this case, therefore, a size of the ink-jet recording apparatus with respect to the direction parallel to the ink ejection face is inevitably increased.

SUMMARY OF THE INVENTION

An object of the present invention is to provide an ink-jet recording apparatus capable of space saving with respect to both directions perpendicular to and parallel to an ink ejection face.

According to a first aspect of the present invention, there is provided an ink-jet recording apparatus comprising a first carriage, a second carriage, and a carriage-moving mechanism. The first carriage is reciprocally movable in parallel with an ink ejection face of an ink-jet head. The second carriage is separate from the first carriage and reciprocally movable in the same direction as a movement direction of the first carriage. The carriage-moving mechanism selectively moves the first carriage and the second carriage. The first carriage is mounted with at least any one of a wiper that wipes off ink adhering to the ink ejection face, a sheet that receives ink ejected from the ink-jet head, a cap that seals the ink ejection face, and a shutter that is disposed to confront the ink ejection face to thereby protect the ink ejection face. The second carriage is mounted with at least any one of the wiper, the sheet, the carriage, and the shutter except the one(s) mounted on the first carriage.

In the foregoing construction, two or more maintenance members selected from the group consisting of the wiper, the sheet, the cap, and the shutter are mounted separately on the first and second carriages. Separately disposing the first and second carriages, which are separate from each other and reciprocally movable in the same direction, realizes space saving in the ink-jet recording apparatus with respect to both directions perpendicular to and parallel to the ink ejection face.

BRIEF DESCRIPTION OF THE DRAWINGS

Other and further objects, features and advantages of the invention will appear more fully from the following description taken in connection with the accompanying drawings in which:

FIGS. 32A and 32C are top views for explanation for space-saving of the ink-jet printer according to the first embodiment of the present invention.

DESCRIPTION OF THE PREFERRED EMBODIMENTS

In the following, preferred embodiments of the present invention will be described with reference to the accompanying drawings.

Figure 1:
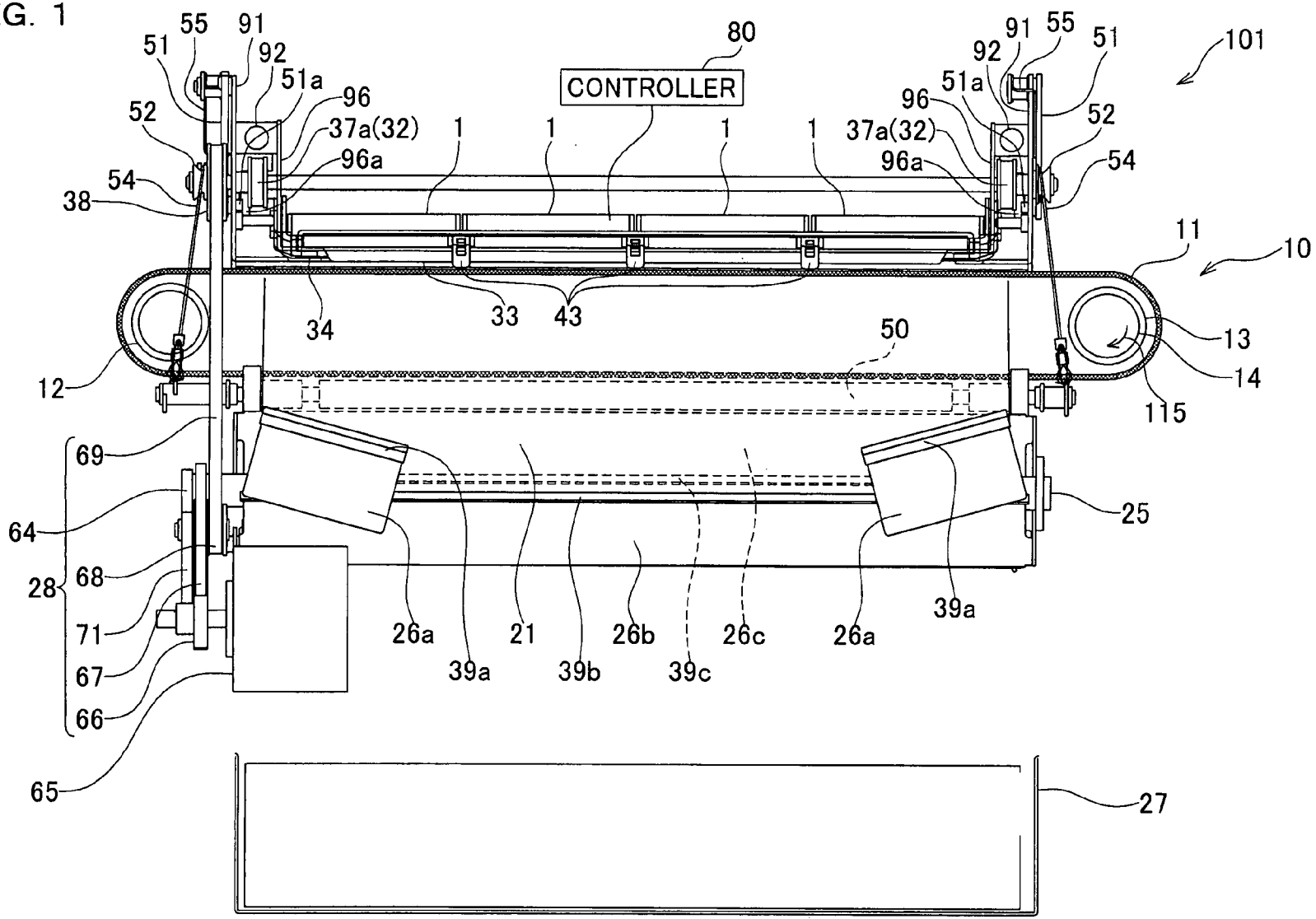
FIG. 1 schematically illustrates a construction of an ink-jet printer according to a first embodiment of the present invention.

First will be described a first embodiment in which an ink-jet recording apparatus of the present invention is applied to an ink-jet printer. As illustrated in FIG. 1, an ink-jet printer 101 of this embodiment includes four ink-jet heads 1 each having a substantially rectangular parallelepiped shape, a paper conveyance mechanism 10 that conveys a paper as a recording medium, maintenance members used for maintenance of the ink-jet heads 1, and a controller 80 that controls an operation of the ink-jet printer 101.

Head maintenance employed in this embodiment includes a "purge operation", an "ink removal operation", and a "capping". The purge operation is to eject ink from the head 1 onto a purge sheet 21 so that ink having high viscosity or containing foreign matters is forcibly discharged from nozzles 8. The ink removal operation is to, after the purge operation, remove ink adhering to a surface of the purge sheet 21 and ink adhering to an ink ejection face 4*a* of the head 1. The capping is to seal the ink ejection face 4*a* of the head 1 with a cap of a capping unit 35 in order to prevent ink left within the nozzles from drying up.

The four ink-jet heads 1, which eject ink of respective colors, i.e., cyan, yellow, magenta, and black, are disposed adjacent to one another in their widthwise direction. The four ink-jet heads 1 are movable in a vertical direction by an elevator mechanism (not illustrated), and are controlled by the controller 80 to selectively take, from a position nearest to the paper conveyance mechanism 10, a printing position, a maintenance position, and a withdrawal position.

Here, with reference to FIGS. 2 and 3, the ink-jet heads 1 will be described in detail. Each of the ink-jet heads 1 includes an ink reservoir block 3 and a head main body 2.

Within the ink reservoir block 3, two ink supply passages 6 both extending along a longitudinal direction of the ink reservoir block 3 are provided in parallel to each other in a widthwise direction of the ink reservoir block 3. Ink is flown through openings 6*a* (see FIG. 3), which are formed in an upper face of the ink reservoir block 3, into the ink supply passages 6, and then supplied from openings 6*b*, which are formed in a lower face of the ink reservoir block 3, to the head main body 2.

Figure 2:
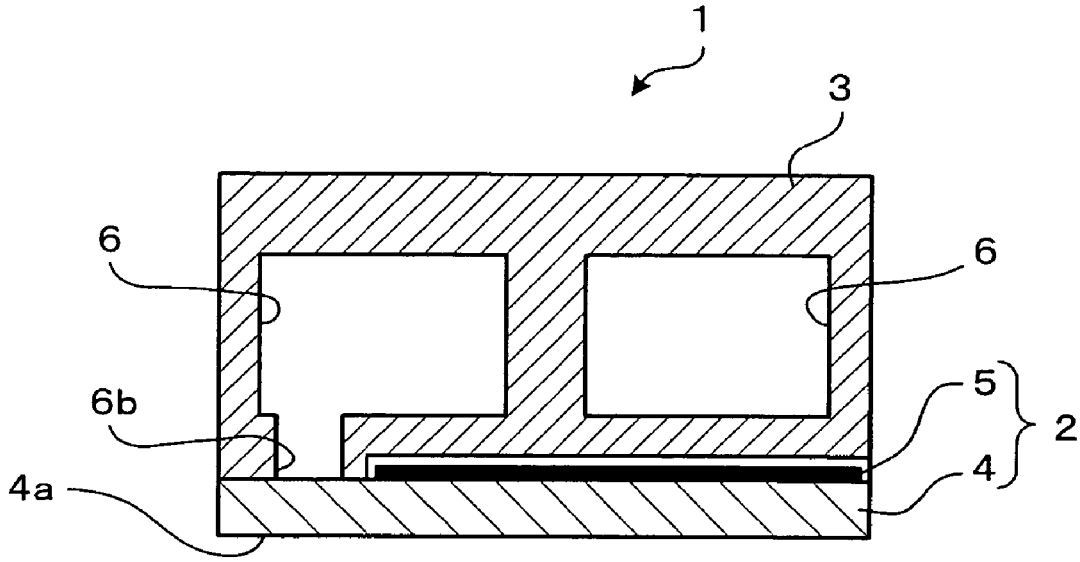
FIG. 2 is a widthwise sectional view of a head included in the ink-jet printer of FIG. 1.
Figure 3:
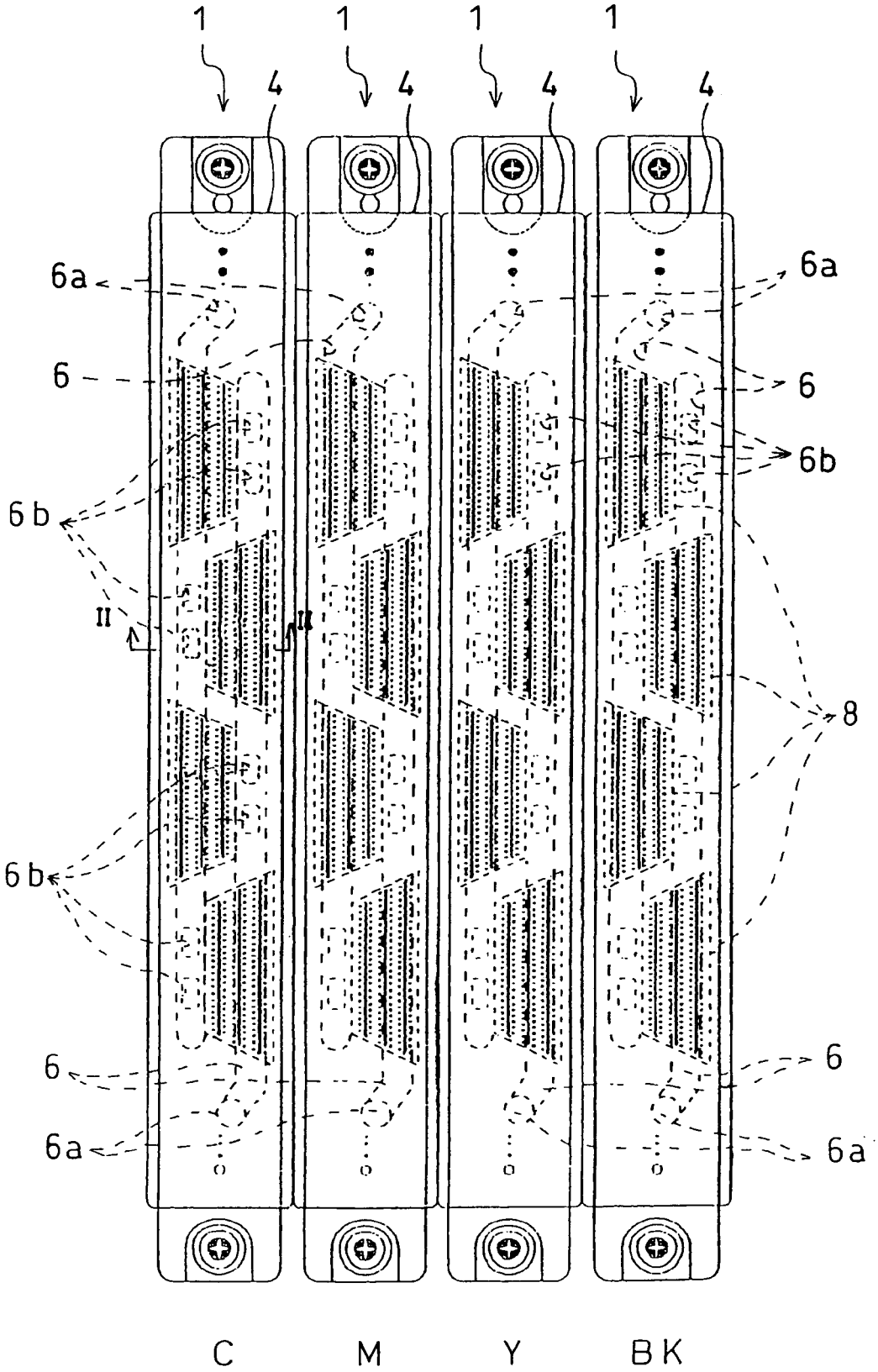
FIG. 3 is a plan view of four heads included in the ink-jet printer of FIG. 1.

As illustrated in FIG. 2, the head main body 2 includes a passage unit 4 and an actuator unit 5 that change the volume of pressure chambers formed in the passage unit 4.

An ink ejection face 4*a* having a large number of nozzles 8 (see FIG. 3) opened therein is formed in a lower face of the passage unit 4. Formed within the passage unit 4 are individual ink passages each corresponding to each nozzle 8. To be more specific, the individual ink passage extends from an opening (not illustrated), which communicates with the opening 6*b* of the ink reservoir block 3, through a pressure chamber to a nozzle 8. A large number of pressure chambers are formed so as to correspond to the respective nozzles 8.

As illustrated in FIG. 2, the actuator unit 5 is bonded to a portion of an upper face of the passage unit 4 to which the ink reservoir block 3 is not attached, in such a manner that the actuator unit 5 is spaced apart from the lower face of the ink reservoir block 3. One head 1 is provided with four actuator units 5 corresponding to four nozzle groups comprising many nozzles 8 as illustrated in FIG. 3. The four actuator units 5 are disposed in a zigzag pattern along a longitudinal direction of the head 1. Each actuator unit 5 has a trapezoidal shape and extends over corresponding one of four pressure chamber groups including a large number of pressure chambers. When the controller 80 drives the actuator unit 5, pressure chambers corresponding to this actuator unit 5 are reduced in volume, so that ink is ejected through the nozzles 8.

Next, a paper conveyance mechanism 10 will be described with reference to FIG. 1.

The paper conveyance mechanism 10 has two belt rollers 12 and 13 whose axes extends along the longitudinal direction of the head 1, a looped conveyor belt 11 that is wound around and spans the belt rollers 12 and 13, and a motor 14 that drives the belt roller 13. When the motor 14 drives the belt roller 13 into clockwise rotation as shown by an arrow 115 of FIG. 1, the conveyor belt 11 travels and the other belt roller 12 as well as the belt roller 13 is rotated in a clockwise direction. Since an outer face (i.e., a conveyor face) of the conveyor belt 11 is treated with silicone, a paper is kept on the conveyor face of the conveyor belt 11 and in this condition conveyed from left to right in FIG. 1.

In the following, an upstream side in the paper conveyance direction, i.e., a left side in FIG. 1, is referred to as a front side of the printer, and a downstream side in the paper conveyance direction, i.e., a right side in FIG. 1, is referred to as a rear side of the printer.

Next, maintenance members will be described with reference to FIGS. 4, 5, and 6.

Figure 6:
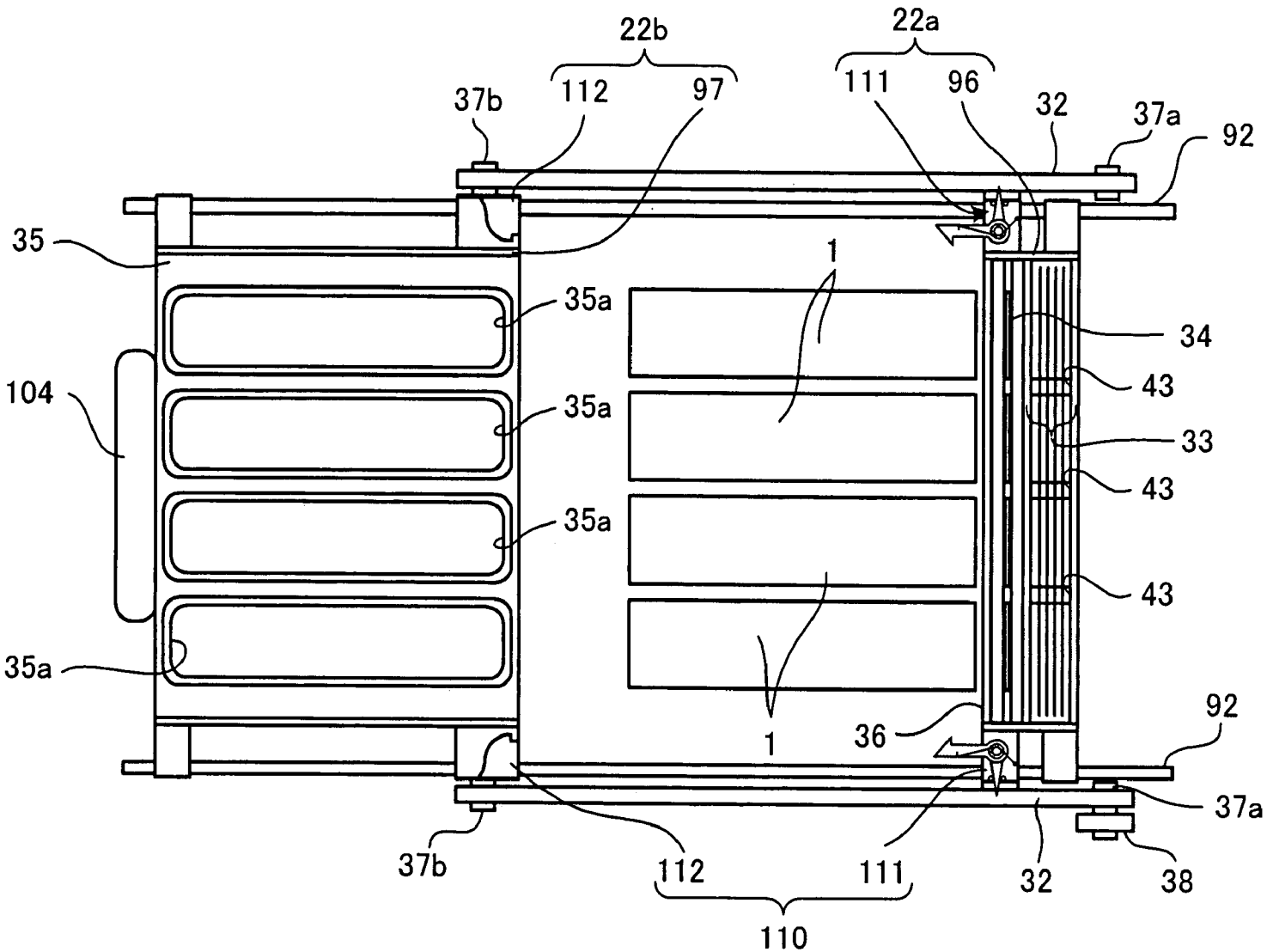
FIG. 6 is a top view of the ink-jet printer of FIG. 1.

The maintenance members employed in this embodiment are a purge sheet 21 (see FIG. 4), comb teeth 33, a wiper 34, and a capping unit 35 (see FIG. 6). The purge sheet 21, the comb teeth 33, and the wiper 34 are supported on a main carriage 22*a,* and the capping unit 35 is supported on a sub carriage 22*b.*

The purge sheet 21 is a long, flexible sheet, and its surface and back face have been given a water repellent treatment. One longitudinal end of the purge sheet 21 is fixed to a sheet holder 36 (see FIG. 5) of a later-described main carriage 22*a*. The other end portion of the purge sheet 21 is wound around a shaft 25 and receives tension by a tension unit 24. The shaft 25 is disposed lower than the paper conveyance mechanism 10 and lies horizontally along a widthwise direction of the head 1. A tension unit 24, a mechanism for bringing ink that has been ejected on to the purge sheet 21 into a waste ink tank 27, and the like will be detailed later.

Figure 4:
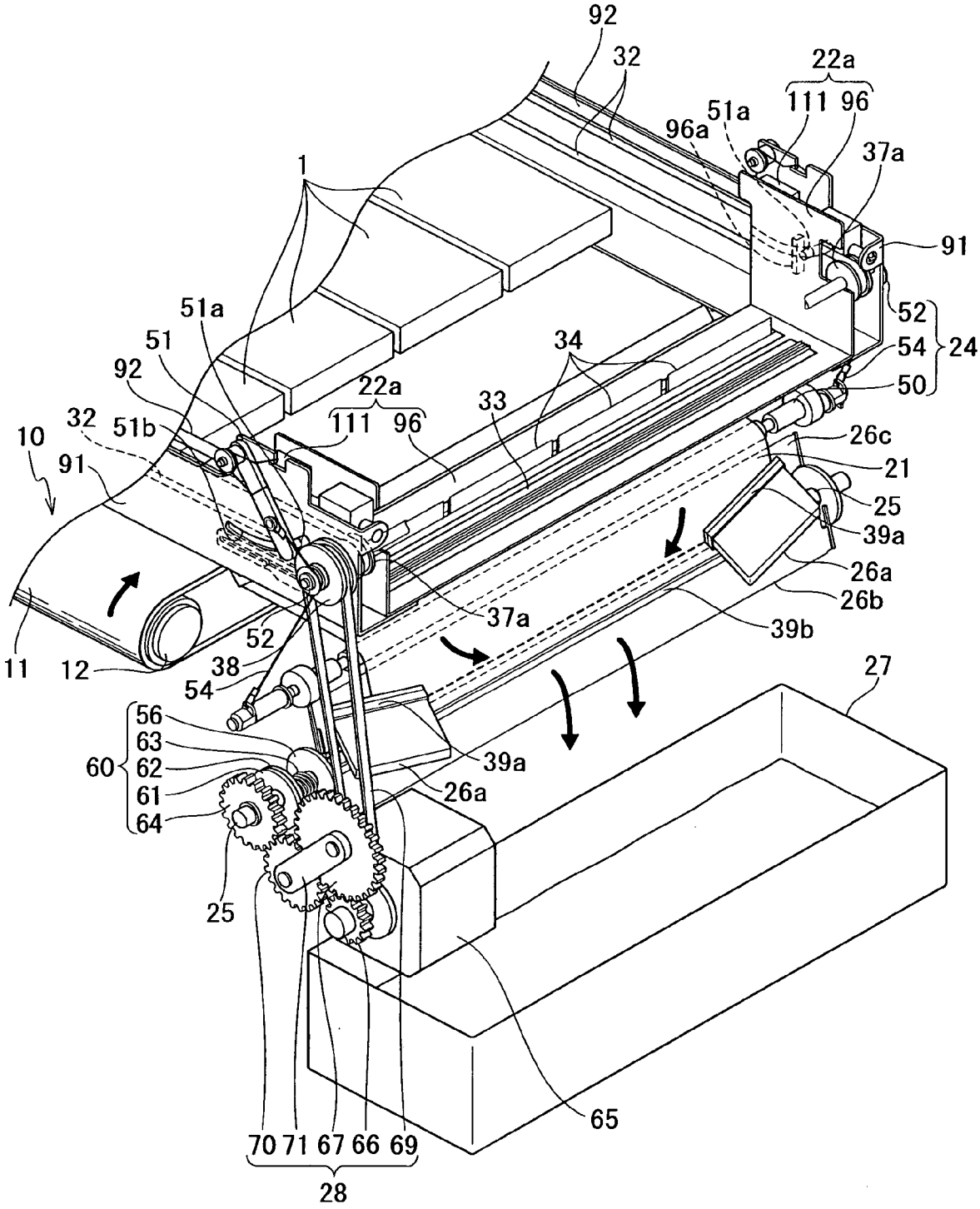
FIG. 4 is a perspective view of the ink-jet printer of FIG. 1.

As illustrated in FIGS. 4 and 6, the comb teeth 33 include four thin plates that are disposed at regular intervals with respect to the longitudinal direction of the head 1. Each of the thin plates is slightly longer than a total of widths of the four heads 1 disposed in parallel, and extends in the widthwise direction of the heads 1 in a standing posture. As illustrated in FIG. 6, restriction members 43 are provided at a lower end of each thin plate of the comb teeth 33. The restriction member 43 is disposed at a position corresponding to each space between the heads 1. The restriction member 43 protrudes downward beyond the thin plates of the comb teeth 33 (see FIG. 1), thereby preventing the purge sheet 21 from coming into contact with the lower ends of the thin plates of the comb teeth 33.

As illustrated in FIGS. 4 and 6, the wiper 34 has four thin plates each corresponding to each of the four heads 1. These thin plates, which are made of a flexible material such as urethane rubber, etc., are disposed in line along the widthwise direction of the heads 1, and extend in the widthwise direction of the heads 1 in a standing posture.

The comb teeth 33 and the wiper 34 serve to perform the ink removal operation which forms a part of the maintenance of the head 1.

As illustrated in FIG. 6, the capping unit 35 has four ring-shaped ribs 35*a* formed on an upper face of a rectangular plate. The shape of each rib 35*a* is substantially identical to an outer edge of the ink ejection face 4*a* of the head 1. Each rib 35*a* and the plate form a cap for sealing the ink ejection face 4*a*.

Next, the carriages 22*a* and 22*b* for maintenance members will be described. As illustrated in FIG. 6, the main carriage 22*a* and the sub carriage 22*b* are disposed on right and left sides, respectively, as seen from the front side of the printer (hereinafter simply referred to as right and left sides of the printer). The main carriage 22*a* and the sub carriage 22*b* are reciprocally movable along the longitudinal direction of the heads 1 (i.e., along a transverse direction of the printer) by a later-detailed moving mechanism. Positions where the main carriage 22*a* and the sub carriage 22*b* are located in FIG. 6 are referred to as "parking positions".

As illustrated in FIG. 4, the main carriage 22*a* includes a U-shaped carriage frame 96 and two male units 111. The U-shaped carriage frame, 96 is disposed between a pair of L-shaped frames 91. The male unit 111 is disposed between the carriage frame 96 and the L-shaped frame 91. The wiper 34 and the comb teeth 33 stand on a top surface of a baseplate of the carriage frame 96. A sheet holder 36 (see FIG. 6) is attached to an undersurface of the baseplate of the carriage frame 96.

One longitudinal end of the purge sheet 21 is fixed to the sheet holder 36. A length of the sheet holder 36 is shorter than a width of the purge sheet 21. Both widthwise end portions of the purge sheet 21 beyond the sheet holder 36 are bent upward and secured to both end faces of the sheet holder 36. As a result, the purge sheet 21 is, over some length thereof from the sheet holder 36 to the shaft 25, bent into a concave shape with respect to its widthwise direction, which is suitable for receiving ink.

Figure 5:
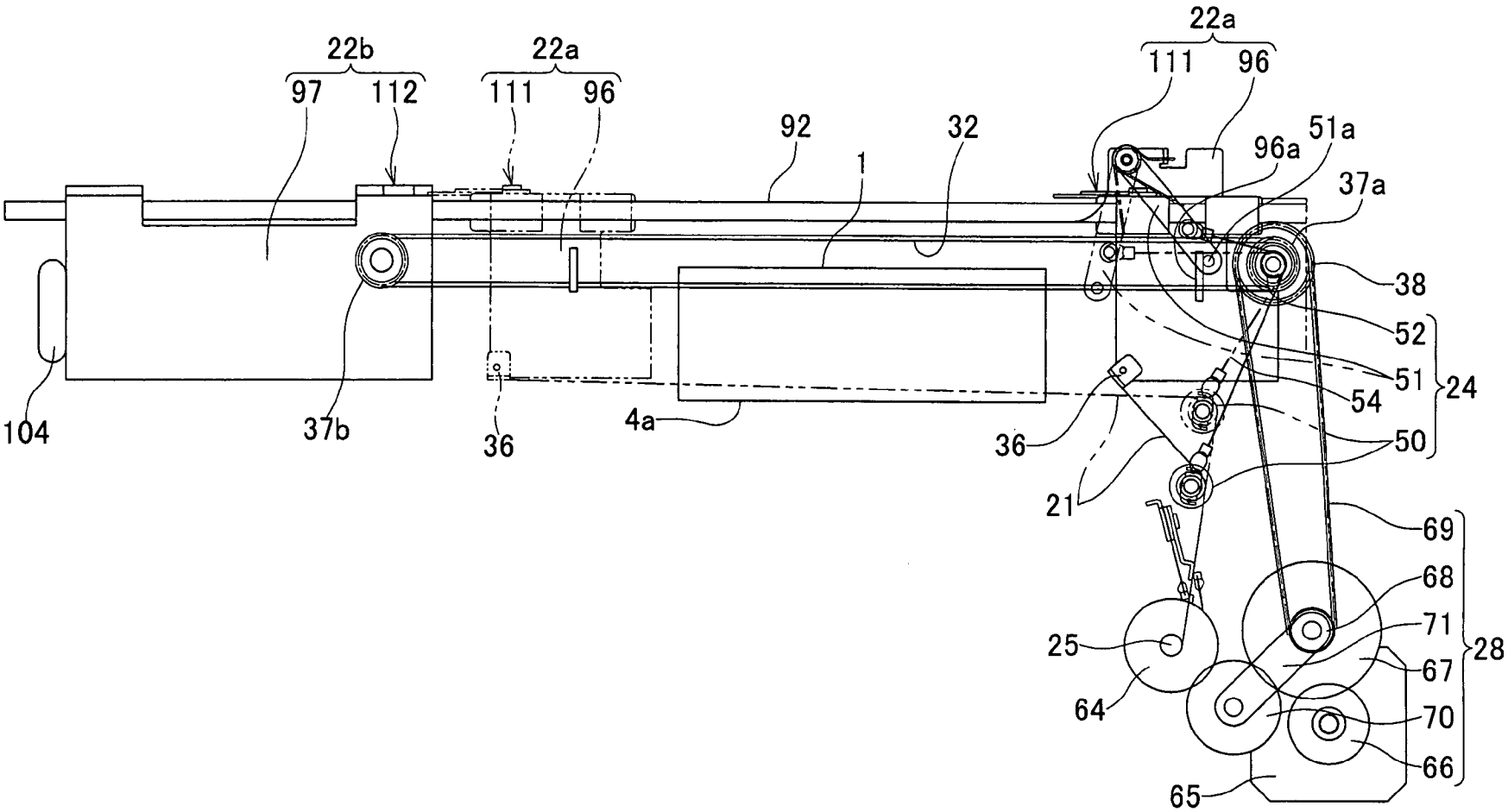
FIG. 5 is a side view of the ink-jet printer of FIG, 1 as seen from its front side.

As illustrated in FIGS. 5 and 6, the sub carriage 22*b.* includes a U-shaped carriage frame 97 which is the same as the carriage frame 96 of the main carriage 22*a*. The sub carriage 22*b* also includes two female units 112 each disposed between the carriage frame 97 and each L-shaped frame 91. The capping unit 35 is mounted on a top surface of a baseplate of the carriage frame 97 (see FIG. 6).

Next, a moving mechanism for the carriages 22*a* and 22*b* will be described.

A moving mechanism for the carriages 22*a* and 22*b* includes: a pair of guide bars 92 extending in the longitudinal direction of the head so as to sandwich the four ink-jet heads 1 therebetween; two pairs of belt rollers 37*a* and 37*b* disposed at both ends of each guide bar 92, respectively, as shown in FIG. 6; looped belts 32 each spanning the belt rollers 37*a* and 37*b* and both having the main carriage 22*a* fixed thereto; a connection/disconnection mechanism 110 comprising a combination of the connectable and disconnectable male and female units 111 and 112; and a later-detailed gear unit 28.

Although the belt 32 is actually located below the guide bar 92, the belt 32 and the guide bar 92 shown in FIG. 6 do not overlap with respect to the vertical direction for explanation purposes. As illustrated in FIGS. 1 and 4, the guide bar 92, the belt rollers 37*a* and 37*b,* the belt 32, and the connection/disconnection mechanism 110 are all disposed between the L-shaped frame 91 and the carriage frame 96 or 97.

As illustrated in FIG. 4, each guide bar 92 is fixed to the L-shaped frame 91 which is a part of a main frame of the printer 101. The guide bars 92 and the L-shaped frames 91 are symmetrically disposed on both sides of the four ink-jet heads 1, and extend substantially the entire length of the printer in its transverse direction. The male unit 111 of the main carriage 22*a* and the female unit 112 of the sub carriage 22*b* are supported on the guide bar 92 in a slidable manner.

The belt rollers 37*a* and 37*b* (only the former one of which are illustrated in FIG. 4) are disposed apart from each other with respect to an extension direction of the guide bar 92, and at the same time supported on the L-shaped frame 91 in a rotatable manner. The belt roller 37*a* located on a front-right side of the printer (i.e., shown on the left side in FIGS. 1 and 4) is coaxially connected to a sub pulley 38 with the L-shaped frame 91 sandwiched therebetween. A diameter-of the sub pulley 38 is larger than that of the belt roller 37*a*. As will be detailed later, when driving of the motor 65 is submitted via the gear unit 28 to the sub pulley 38, the belt roller 37*a* accompanying the sub pulley 38 is rotated. The belt 32 travels in association with the rotation of the belt roller 37*a,* and then the other belt roller 37*b* is slaved to the belt 32 and rotated. While the belt 32 is traveling, the main carriage 22*a* fixed to the belt 32 moves with its male unit 111 sliding along the guide bar 92.

The sub carriage 22*b* located at the parking position is, on its left side, provided with a stopper 104 for restricting the sub carriage 22*b* from moving (see FIGS. 5 and 6).

Next, the respective units 111 and 112 of the connection/disconnection mechanism 110 will be described with reference to FIGS. 7, 8, 9, 10, and 11.

Figure 7:
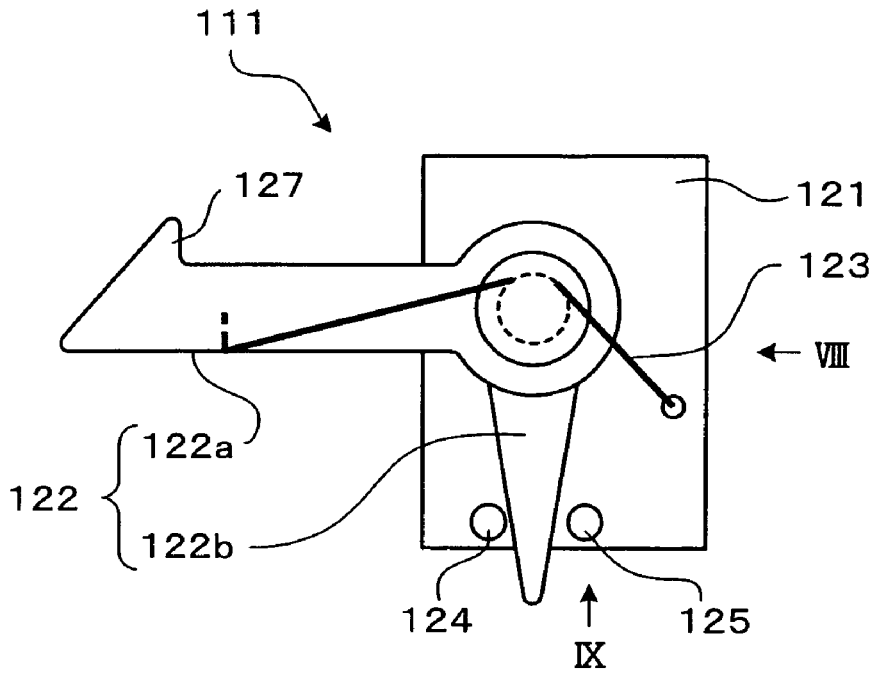
FIG. 7 is a top view of a male unit of a main carriage included in the ink-jet printer of FIG. 1.

Referring to FIG. 7, the male unit 111 includes a sliding member 121, a male member 122, a spring 123, a restriction pin 124, and a latch pin 125.

Figure 8:
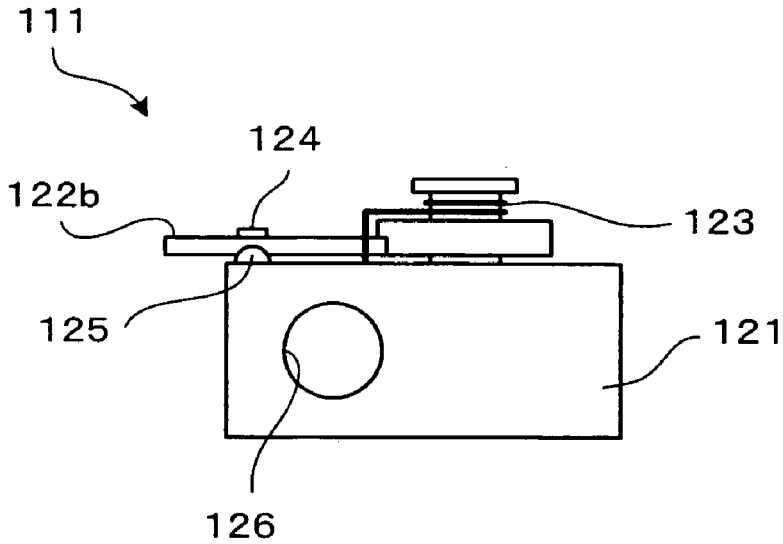
FIG. 8 is a side view of the male unit as seen in a direction of an arrow VIII shown in FIG. 7.
Figure 9:
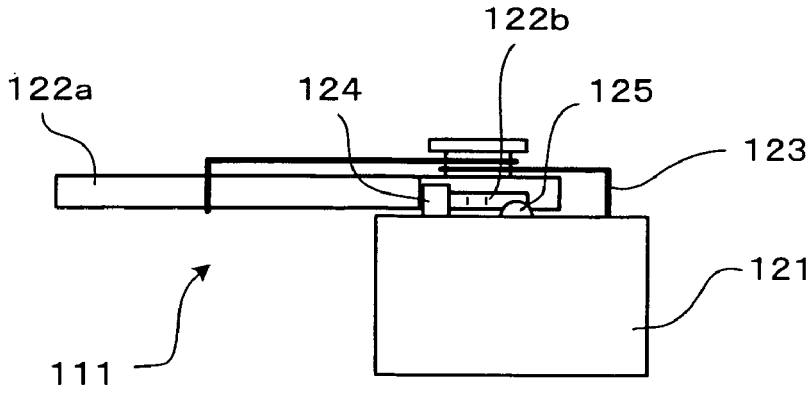
FIG. 9 is a side view of the male unit as seen in a direction of an arrow IX shown in FIG. 7.

The sliding member 121 is a rectangular parallelepiped member that supports the male member 122, the spring 123, the restriction pin 124, and the latch pin 125. Referring to FIG. 8, a side of the sliding member 121 has a hole 126 through which the guide bar 92 passes.

The male member 122 has a thin plate 122*a* having a halved-arrow shape and a thin plate 122*b* having a tapered shape. The thin plate 122*a* has a protrusion 127 that is engageable with an engagement portion 137 of the female unit 112 (see FIG. 10). Base portions of the thin plates 122*a* and 122*b* overlap each other at a right angle. The thin plates 122*a* and 122*b* are supported on the sliding member 121 such that they may rotate around their base portions over a plane of the thin plates.

The spring 123 biases the male member 122 clockwise in FIG. 7.

The restriction pin 124 has a cylindrical shape and stands on an upper face of the sliding member 121. The restriction pin 124 comes into contact with the thin plate 122*b* of the male member 122, so that it restricts the male member 122, which is biased by the spring 123, from rotating clockwise in FIG. 7.

The latch pin 125 has a semispherical shape and stands on the upper face of the sliding member 121. When the male member 122, having been in the state of FIG. 7, rotates counterclockwise, the latch pin 125 comes into contact with the thin plate 122*b* to thereby restrict the male member 122 from rotating counterclockwise. However, the latch pin has the semispherical shape of relatively low height. Therefore, when the male member 122 receives excessive counterclockwise rotational force, the thin plate 122*b* goes beyond the latch pin 125 into a state as shown in FIG. 13B.

Figure 13A:
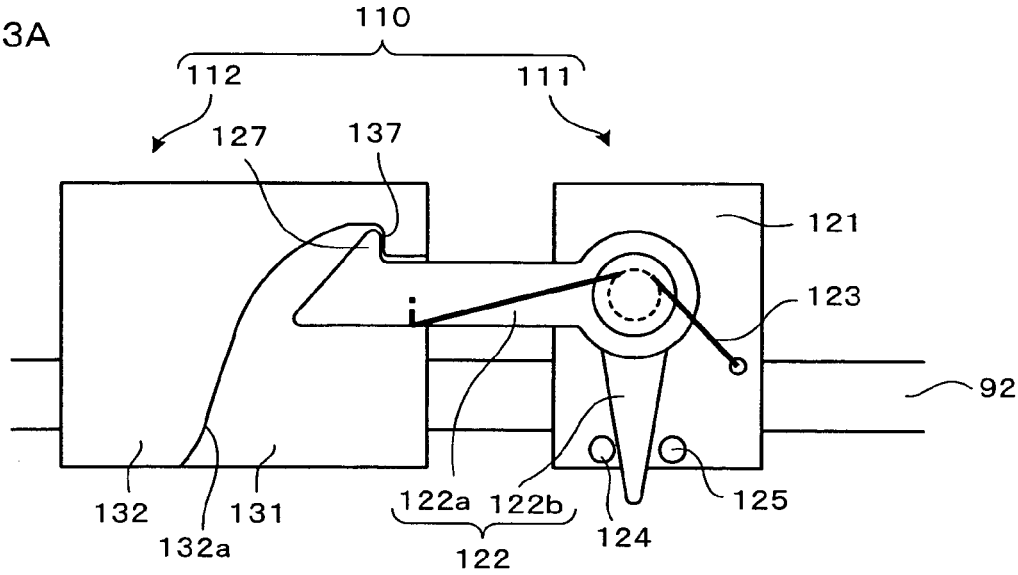
FIGS. 13A, 13B, and 13C are top views showing how the male unit and the female unit are separated from each other.
Figure 13B:
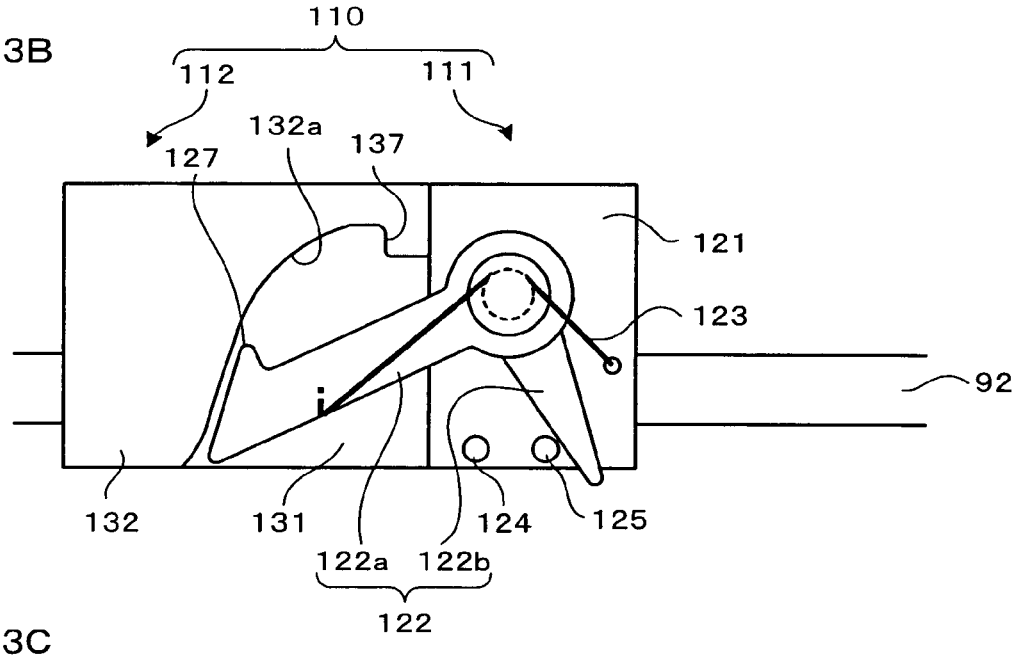

The male member 122 selectively takes a "connection position" as shown in FIG. 7 and a "disconnection position" as shown in FIG. 13B. When the male member 122 is in the connection position the thin plate 122*b* is located between the restriction pin 124 and the latch pin 125, and when the male member 122 is in the disconnection position the thin plate 122*b*is located beyond the latch pin 125.

Figure 10:
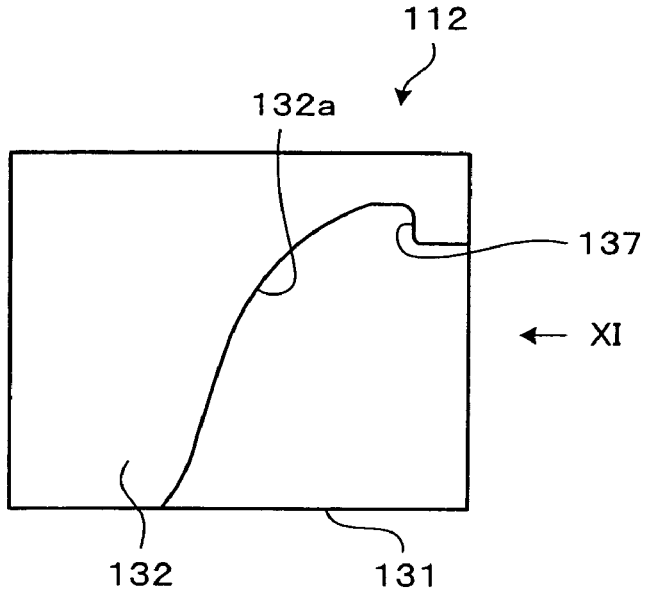
FIG. 10 is a top view of a female unit of a sub carriage included in the ink-jet printer of FIG. 1.

Referring to FIG. 10, the female unit 112 includes a sliding member 131 and a female member 132.

Figure 11:
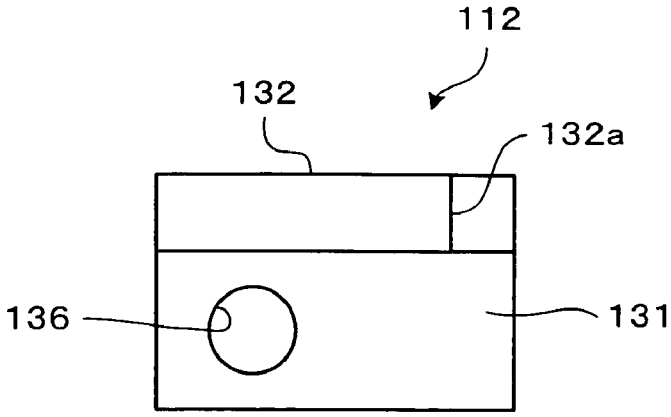
FIG. 11 is a side view of the female unit as seen in a direction of an arrow XI shown in FIG. 10.

The sliding member 131 is a rectangular parallelepiped member that supports the female member 132. Referring to FIG. 11, a side of the sliding member 131 has a hole 136 through which the guide bar 92 passes.

The female member 132 is a plate member having, in a plan view, substantially the same shape as that of the sliding member 131. The female member 132 is disposed on an upper face of the sliding member 131. A side part of the female member 132 opposed to the male unit 111 has a curved notch 132*a*, and a part of the notch 132*a* forms an engagement portion 137 that is engageable with the protrusion 127 of the thin plate 122*a* of the male unit 111.

Next, a connection between the male unit 111 and the female unit 112 will be described with reference to FIGS. 12A, 12B, and 12C.

Figure 12A:
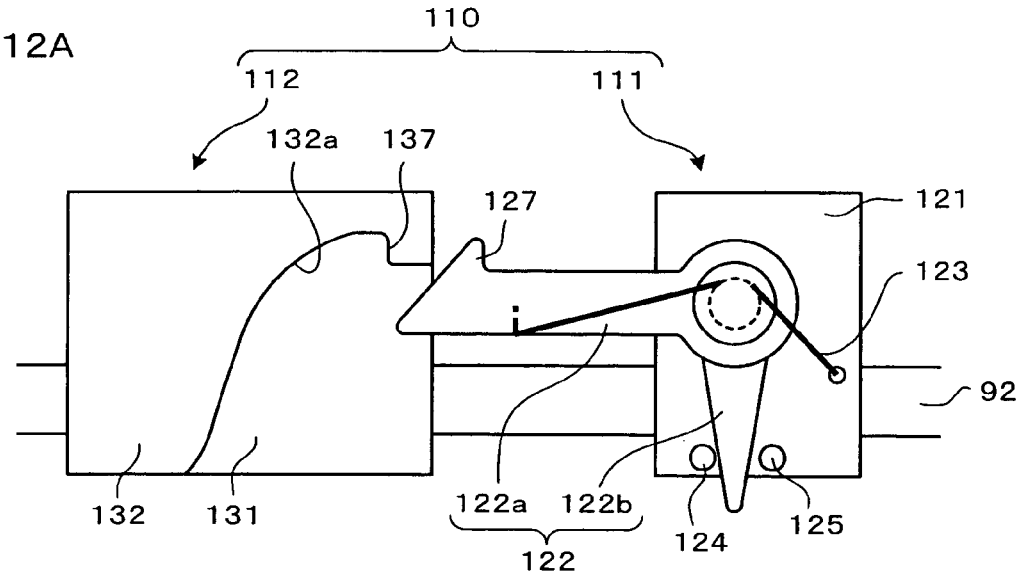
FIGS. 12A, 12B, and 12C are top views showing how the male unit and the female unit are connected to each other.

Referring to FIG. 12A, the male member 122 is located in the connection position, and the protrusion 127 of the thin plate 122*a* has not reach the female unit 112 yet. When the male unit 111 in the state of FIG. 12A becomes closer to the female unit 112, the protrusion 127 of the thin plate 122*a* is pushed by a wall of the female member 132 defining the notch 132*a* as illustrated in FIG. 12B, so that the male member 122 rotates counterclockwise. The thin plate 122*b* of the male member 122 accordingly gets away from the restriction pin 124 and comes into contact with the latch pin 125. When the male unit 111 in the state of FIG. 12B becomes closer to the female unit 112, the protrusion 127 which is still pushed by the wall that defines the notch 132*a* moves ahead, and then becomes engaged with the engagement portion 137 formed in the notch 132*a* as shown in FIG. 12C. The male unit 111 and the female unit 112 are thereby connected to each other.

Even if the male unit 111, which is connected to the female unit 112, is intended to be separated from the female unit 112, the male unit 111 and the female unit 112 move together without being separated because the protrusion 127 is hooked to the engagement portion 137. Referring to FIG. 12C, for example, when the male unit 111 is pulled rightward, the male unit 111 and the female unit 112 move together rightward.

In a case where the female unit 112 is slidable with respect to the guide bar 92, if the male unit 111 which is connected to the female unit 112 is intended to be further closer to the female unit 112, the male unit 122 does not rotate counterclockwise but the protrusion 127 goes ahead pushing the wall that defines the notch 132*a* so that the male unit 111 and the female unit 112 move together. Referring to FIG. 12C, for example, when the male unit 111 is moved leftward, the male unit 111 and the female unit 112 move together leftward.

Next, a separation of the male unit 111 and the female unit 112 from each other will be described with reference to FIGS. 13A, 13B, and 13C. When the units 111 and 112 are separated from each other, the female unit 112 is kept unslidable with respect to the guide bar 92, In FIG. 13A, the male unit 111 and the female unit 112 are connected. When, in this state, the male unit 111 gets closer to the female unit 112, the thin plate 122*a* of the male member 122 of the male unit 111 has its end pushed by the wall that defines the notch 132*a* of the female member 132 of the female unit 112, so that the male member 122 rotates counterclockwise. Thus, the thin plate 122*b* goes beyond the latch pin 125, and at the same time the protrusion 127 of the thin plate 122*a* and the engagement portion 137 of the notch 132*a* are disengaged from each other, so that the male member 122 is located at the disconnection position as shown in FIG. 13B.

Although the spring 123 biases the male member 122 in a clockwise direction, such biasing force is not enough to allow the thin plate 122*b* to go beyond the latch pin 125 again and therefore the male member 122 does not return from the disconnection position shown in FIG. 13B to the connection position shown in FIG. 13A.

Figure 13C:
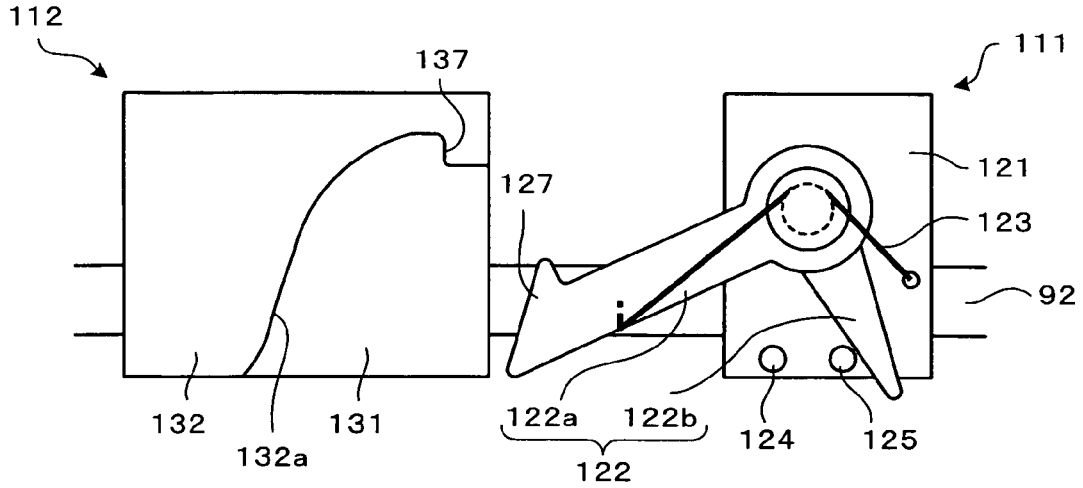

When the male member 122, which is located in the disconnection position as shown in FIG. 13B, is pulled away from the female unit 112, the male unit 111 and the female unit 112 are separated from each other (see FIG. 13C).

In order to reconnect the male unit 111 and the female unit 112 after these units are once separated, the male member 122 which is located in the disconnection position should return to the connection position as shown in FIG. 13A. That is, the male member 122 should be rotated clockwise so that the thin plate 122*b* may go beyond the latch pin 125 again. Therefore, an abutment member 139 is provided near the guide bar 92 (see FIG. 14A).

Figure 14A:
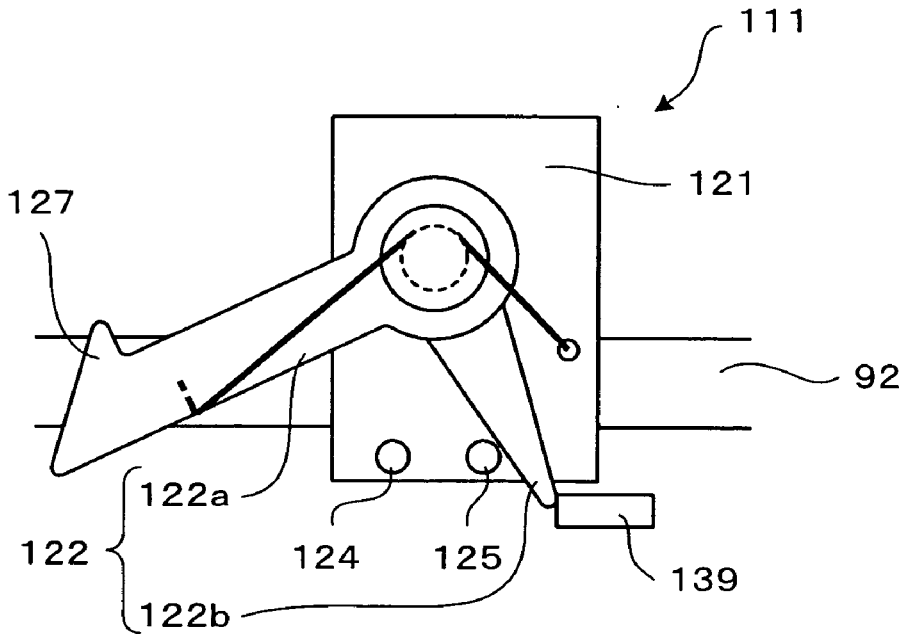
FIGS. 14A and 14B are top views showing how the male unit, which has been separated from the female unit, becomes reconnectable to the female unit.

When the male unit 111 in the state of FIG. 13C is moved further rightward away from the female unit 112, an end of the thin plate 122*b* of the male member 122 comes into contact with the abutment member 139 as shown in FIG. 14A. When the male unit 111 is moved further rightward, the thin plate 122*b* is pushed by the abutment member 139 to go beyond the latch pin 125. Thus, the male member 122 rotates clockwise and returns to the connection position (see FIG. 14B).

Next, with reference to FIGS. 1 and 4, a description will be given to a mechanism for bringing ink having ejected on the purge sheet 21 into a waste ink tank 27. This mechanism includes a pair of ink guide blades 26*a*, an ink scraping blade 26*b*, and a cleaning blade 26*c*.

The waste ink tank 27 has a hollow, rectangular parallelepiped one with its topside opened. The waste ink tank 27 reserves ink having been ejected from the heads 1 during a purge operation. The waste ink tank 27 is located below the shaft 25 at a position covering a course of natural fall of ink which has been scraped off by the ink scraping blade 26*b*and then has moved along the ink scraping blade 26*b* (in FIG. 4, bold arrows shows ink flows).

The pair of ink guide blades 26*a* serves to guide ink having ejected onto the purge sheet 21 to a widthwise center of the purge sheet 21. The pair of ink guide blades 26*a* is located between the shaft 25 and a later-described tension bar 50, and are disposed at positions corresponding to both widthwise ends of the purge sheet 21. An ink removing member 39*a* is attached to an upper side of the ink guide blade 26*a*. The pair of ink guide blades 26*a* is disposed in such a manner that the ink removing members 39*a* may be in contact with a surface of the purge sheet 21 and at the same time a distance between the ink removing members 39 may become narrower at a lower side.

The ink scraping blade 26*b* scrapes ink, which has been guided by the ink guide blade 26*a* to the widthwise center of the purge sheet 21, off the purge sheet 21. The ink scraping blade 26*b* is located below the ink guide blades 26*a*. An ink removing member 39*b* is attached to an upper side of the ink scraping blade 26*b*. The ink scraping blade 26*b* is disposed in such a manner that its upper side may extend along the shaft 25 and at the same time the ink removing member 39*b* may be in contact with the surface of the purge sheet 21 wound around the shaft 25.

The cleaning blade 26*c* serves to scrapes off ink adhering to a back face of the sheet 21 when the sheet 21 is unwound from and pulled out of the shaft 25 during the purge operation. The cleaning blade 26*c* is located between the shaft 25 and the tension bar 50. An ink removing member 39*c* is attached to a lower side of the cleaning blade 26*c*. The cleaning blade 26*c* is disposed in such a manner that the ink removing member 39*c* may be in contact with the back face of the purge sheet 21.

Next, with reference to FIGS. 4 and 5, a description will be given to a tension unit 24 that applies tension to the purge sheet 21. As illustrated in FIG. 5, the tension unit 24 includes a tension bar 50, wire rollers 52, and displacement arms 51. The wire rollers 52 and the displacement arms 51 are disposed at both ends of the tension bar 50.

Figure 15B:
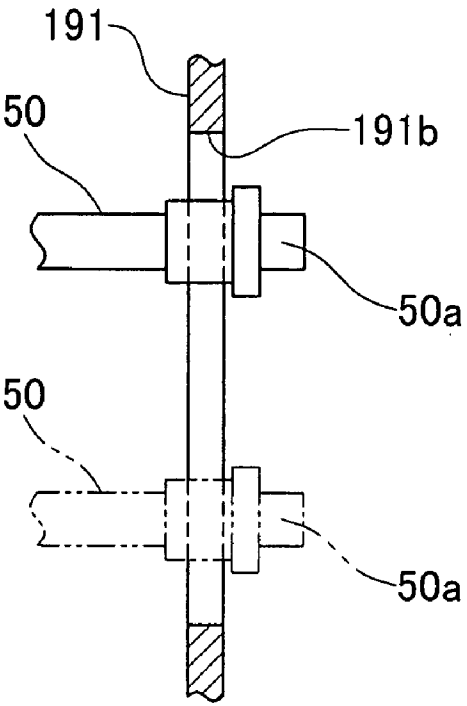
FIG. 15B shows a section taken along a line B-B of FIG. 15A.
Figure 15A:
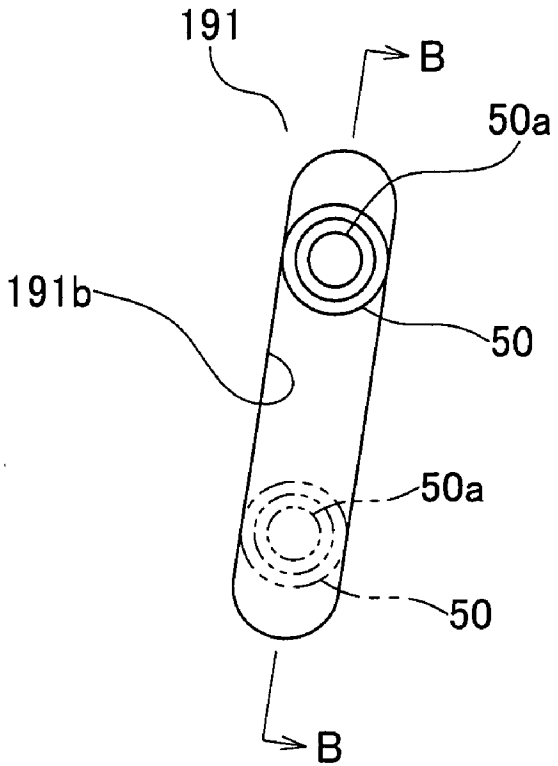
FIG. 15A is a side view showing an end portion of a tension bar that applies tension to a purge sheet.

Below the main carriage 22*a* in the parking position, the tension bar 50 is disposed horizontally along the widthwise direction of the head 1 (i.e., along a direction perpendicular to the drawing sheet of FIG. 5). As illustrated in FIGS. 15A and 15B, the tension bar 50 is supported on a pair of frames 191 so as to be movable in the vertical direction, The pair of frames 191 is a part of the main frame of the printer 101. To be more specific, since both ends 50*a* of the tension bar 50 are inserted into elongated holes 191*b* formed in the frames 191, the tension bar 50 can move along the elongated holes 191*b*. A surface of the tension bar 50 is in contact with the back face of the purge sheet 21.

The shaft 25 around which the other end portion of the purge sheet 21 is wound is disposed below the tension bar 50.

As illustrated in FIGS. 1 and 4, the wire roller 52 is disposed on an outer side of the L-shaped frame 91 (i.e., on a side of the L-shaped frame 91 opposite to its face confronting the head 1). The wire roller 52 is supported on the L-shaped frame 91 such that it may rotate coaxially with the belt roller 37*a*. A wire 54 is hooked around the wire roller 52. The wire 54 has its one end fixed to either end of the tension bar 50 and its other end fixed to the displacement arm 51. The wire roller 52 serves to convert swing of the displacement arm 51 into a vertical movement of the tension bar 50.

As illustrated in FIG. 4, the displacement arm 51 is an elongated thin plate which is, similarly to the wire roller 52, disposed on the outer side of the L-shaped frame 91. A longitudinal end of the displacement arm 51 is supported rotatably on a projection of the L-shaped frame 91 which projects upward. A cylindrical member 51*a*, which is to be inserted into an arc-forming hole 51*b* of the L-shaped frame 91, is formed at the other end of the displacement arm 51. Further, one end of the wire 54 is fixed to this other end portion. The displacement arm 51 is swingable around one longitudinal end thereof while the cylindrical member 51*a* inserted into the hole 51*b* of the L-shaped frame 91 is moving along the hole 51*b*. When the displacement arm 51 swings and accordingly the one end of the wire 54 is moved, the tension bar to which the other end of the wire 54 is fixed is moved up and down via the wire roller 52. The spring 55 (see FIG. 1) biases the displacement arm 51 leftward. When, as will be described later, the cylindrical member 51*a* is separated from an abutment plate 96*a* that is provided on a side face of the carriage frame 96 of the main carriage 22*a*, the cylindrical member 51*a* is kept disposed at a left end of the hole 51*b* (as illustrated with an alternate long and short dash line in FIG. 5).

Figure 16:
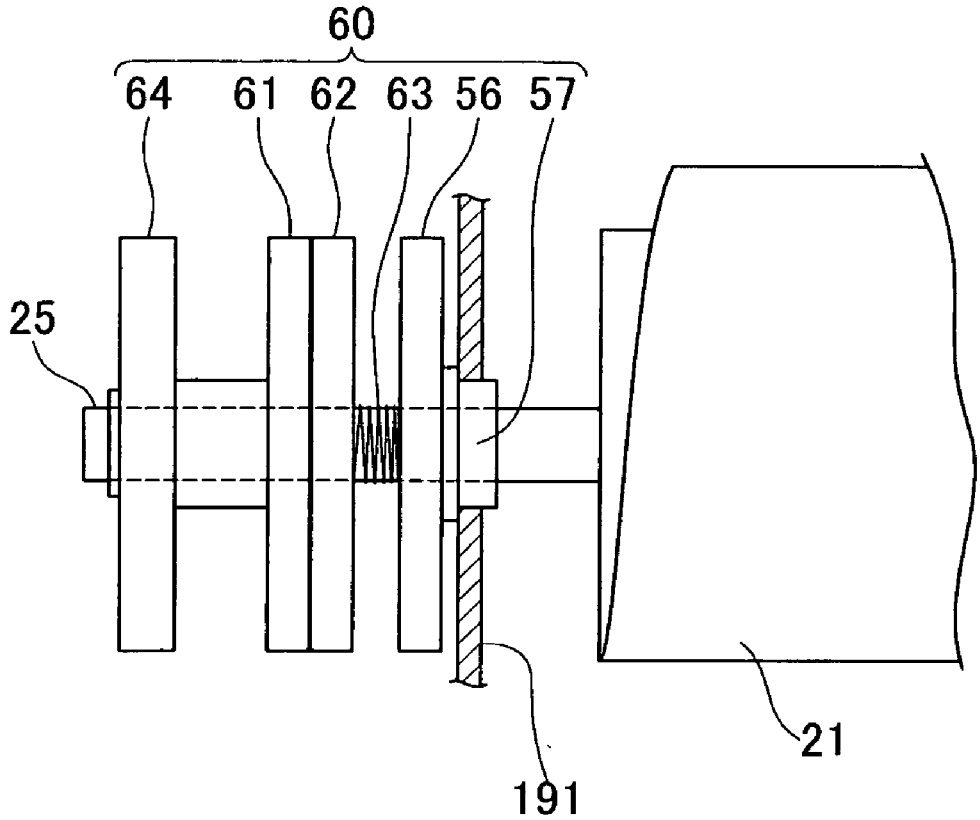
FIG. 16 is an enlarged view of a rotational force transmission mechanism that transmits rotational force to a shaft around which the purge sheet is wound.

Next, with reference to FIGS. 4 and 16, a description will be given to a rotational force transmission mechanism 60 that transmits rotational force to the shaft 25. The rotational force transmission mechanism 60 includes a gear 64, an input plate 61, an output plate 62, a coiled spring 63, a spring receiver 56, and a bearing 57, all of which are disposed coaxially with the shaft 25 at a front end portion of the shaft 25.

The gear 64 and the input plate 61, which are connected so that they can always rotate together, are not fixed to the shaft 25 but are rotatably supported on the shaft 25. The output plate 62 is not connected to the gear 64 and the input plate 61, and fixed to the shaft 25. The spring 63 is wound around the shaft 25 and biases the output plate 62 toward the input plate 61. The spring receiver 56 is not fixed to the shaft 25 but is rotatably supported on the shaft 25. Reaction force of biasing force of the spring 63 is applied to the spring receiver 56 which is therefore pressed against the bearing 57. The bearing 57 is fixed to the frame 191. The shaft 25 is rotatably supported in a hole formed at a center of the bearing 57. Thus, among the members of the rotational force transmission mechanism 60, only the output plate 62 is fixed to the shaft 25.

When no tension is applied to the purge sheet 21, the input plate 61 and the output plate 62 rotate together with friction resistance generated therebetween. Therefore, rotational force transmitted via a later-described gear unit 28 to the gear 64 is then transmitted from the input plate 61 to the output plate 62 so that the shaft 25 fixed to the output plate 62 also rotates. When tension applied to the purge sheet 21 exceeds the friction resistance between the input plate 61 and the output plate 62, the output plate 62 slips against the input plate 61. Therefore, rotational force is not transmitted from the input plate 61 to the output plate 62.

Next, with reference to FIGS. 1, 4, 5 and 17, a description will be given to a gear unit 28 that transmits driving force of the motor 65 to the main carriage 22*a* and to the shaft 25 around which the purge sheet 21 is wound.

Figure 17:
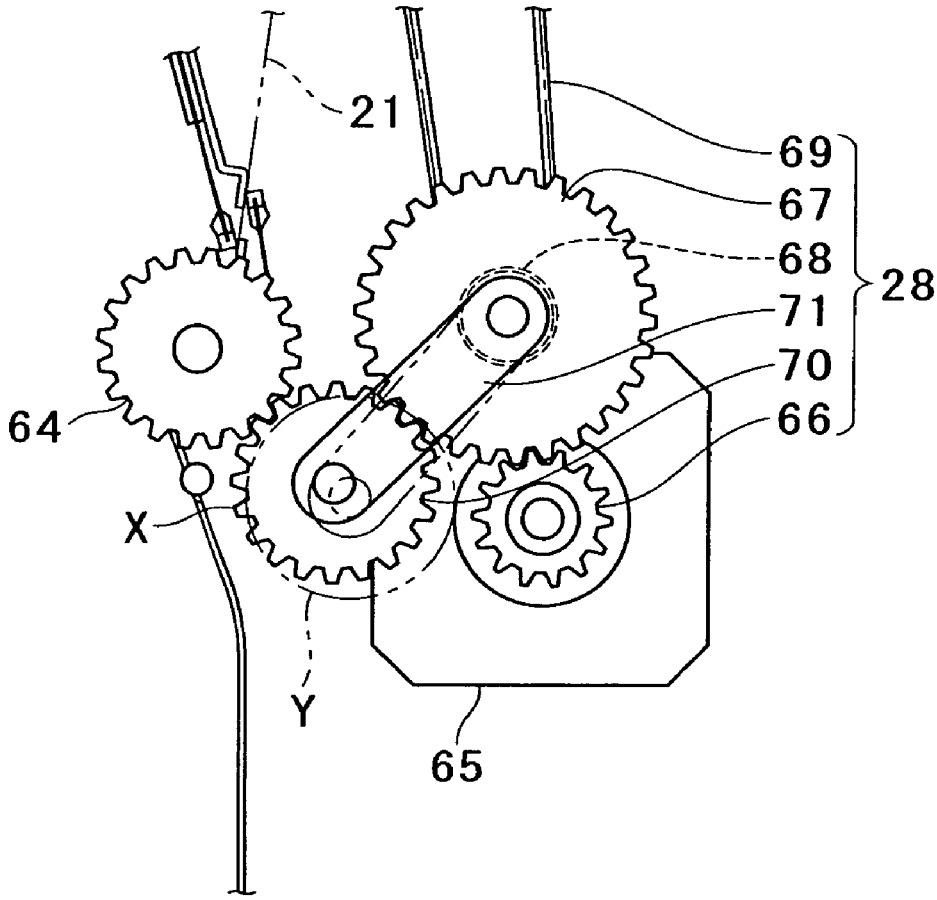
FIG. 17 is an enlarged view of a gear unit that transmits driving force of a motor to the shaft around which the purge sheet is wound and to the main carriage.

As illustrated in FIG. 1, the motor 65 is disposed above the ink tank 27 and on the front side of the printer (i.e., on the left side in FIG. 1). The gear unit 28 is disposed near the motor 65 and includes, as illustrated in FIG. 17, a motor gear 66, a carriage gear 67, a carriage gear pulley 68, the carriage gear belt 69, a planet gear 70, and a connection plate 71.

The motor gear 66 is coaxially connected to an output shaft of the motor 65. The carriage gear 67 in engagement with the motor gear 66 and the planet gear 70 rotates around its fixed axis. The carriage gear pulley 68 is, on an inner face of the carriage gear 67, connected coaxially to the carriage gear 67. A carriage gear belt 69 is a looped belt that is wound around and spans the carriage gear pulley 68 and the sub pulley 38 (see FIGS. 4 and 5).

An axis of the planet gear 70 is connected via the connection plate 71 to a rotation axis of the carriage gear 67, so that the planet gear 70 in engagement with the carriage gear 67 revolves around the carriage gear 67 as a sun gear. When the planet gear 70 is disposed at a position in engagement with the gear 64 (as shown by the reference character X in FIG. 17), the planet gear 70 transmits rotational force to the gear 64, thereby rotating the shaft 25. When the planet gear 70 is disposed at a position out of engagement with the gear 64 (as shown by the reference character Y in FIG. 17), rotational force of the planet gear 70 is not transmitted to the gear 64. A range of revolution of the planet gear 70 is limited such that the planet gear 70 may not interfere with the motor gear 66, etc.

Next, a description will be given to how a purge operation and an ink removal operation as maintenance of heads 1 are performed after a printing operation. In this process, only the main carriage 22*a* moves, and connection between the carriages 22*a* and 22*b* does not occur.

Figure 18A:
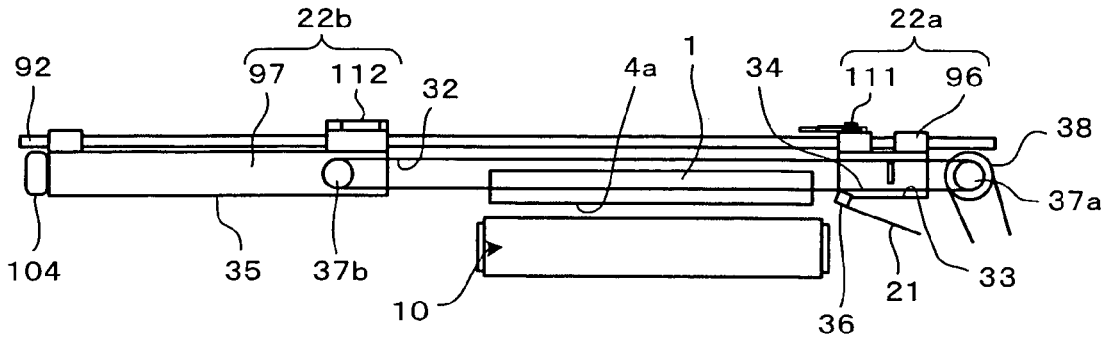
FIGS. 18A to 18D are side views showing how a purge operation and an ink removal operation as head maintenance are performed after a printing operation.

FIG. 18A shows a state during a printing operation. In this state, the head 1 is located in the printing position to conduct a printing by ejecting ink to a paper that has been conveyed by the paper conveyance mechanism 10. The main carriage 22*a* and the sub carriage 22*b* are disposed at the parking positions on right and left sides of the heads 1, respectively. The purge sheet 21 is disposed such that it may not confront the ink ejection faces 4*a* of the heads 1. At this time, as illustrated with a continuous line in FIG. 5, the cylindrical member 51*a* of the displacement arm 51 of the tension unit 24 is pushed by the abutment plate 96*a* that is provided on the side face of the carriage frame 96 of the main carriage 22*a*, so that the cylindrical member 51*a* is positioned on the right side. Accordingly, the tension bar 50, which is connected via the wire 54 to the displacement arm 51, is located in a downward position.

Figure 18B:
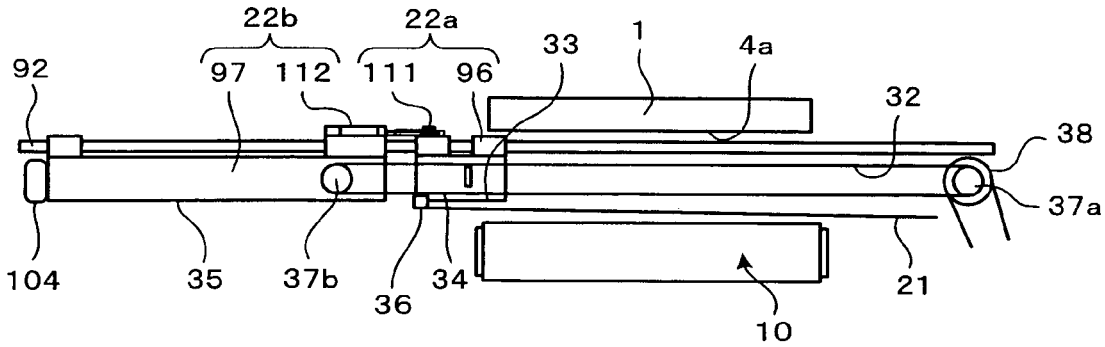

A controller 80 (see FIG. 1), upon determination to perform a purge operation, moves up the heads 1 into the withdrawal position as shown in FIG. 18B and then rotates clockwise an output shaft of the motor 65 (see FIG. 5). This rotation is transmitted, as counterclockwise rotation, via the motor gear 66 to the carriage gear 67.

The counterclockwise rotation of the carriage gear 67 is then transmitted via the carriage gear pulley 68 to the carriage gear belt 69 and further to the sub pulley 38. The sub pulley 38 together with the belt roller 37*a* rotates counterclockwise, and thus the main carriage 22*a* fixed to the belt 32 moves along the guide bar 92 leftward from the parking position shown in FIG. 18A.

In addition, since the carriage gear 67 rotates counterclockwise, as shown in FIG. 17, the planet gear 70 moves counterclockwise around the carriage gear 67 and gets separated from the gear 64 of the rotational force transmission mechanism 60. At this time, no rotational force is transmitted to the gear 64 and therefore the shaft 25 is rotatable freely.

In association with the movement of the main carriage 22*a*, the sheet holder 36 that is attached to the back face of the carriage frame 96 also moves. The purge sheet 21 is accordingly unwound from and pulled out of the shaft 25. At this time, ink adhering to the back face of the purge sheet 21 is scraped off by the cleaning blade 26*c* (see FIG. 4), and then flown into the waste ink tank 27. This can prevent ink from adhering to the conveyor belt 11, etc., of the paper conveyance mechanism 10.

When the main carriage 22*a* starts moving leftward from the parking position shown in FIG. 18A, the abutment plate 96*a* (see FIG. 5) provided on the side face of the carriage frame 96 of the main carriage 22*a* moves leftward in FIG. 18A. The cylindrical member 51*a* of the displacement arm 51 moves accordingly, so that the displacement arm 51 swings clockwise. When the displacement arm 51 swings clockwise, as illustrated with an alternate long and two short dashes line in FIG. 5, the wire 54 draws the tension bar 50 upward.

When the main carriage 22*a* reaches a position adjacent to the sub carriage 22*b* (which means a position on a slightly left side of the purge position shown in FIG. 18B, where the male unit 111 of the main carriage 22*a* and the female unit 112 of the sub carriage 22*b* are not in connection as shown in FIG. 12A), the controller 80 stops the main carriage 22*a* and slightly rotates the output shaft of the motor 65 (see FIG. 5) in the counterclockwise direction. This rotation is transmitted, as clockwise rotation, via the motor gear 66 to the carriage gear 67.

The clockwise rotation of the carriage gear 67 is then transmitted via the carriage gear pulley 68 to the carriage gear belt 69 and further to the sub pulley 38. The sub pulley 38 together with the belt roller 37*a* rotates clockwise, and thus the main carriage 22*a* fixed to the belt 32 moves a little rightward and stops at the purge position shown in FIG. 18B.

In addition, since the carriage gear 67 rotates clockwise, as shown in FIG. 17, the planet gear 70, which has located on the right side and been separated from the gear 64, moves clockwise around the carriage gear 67 into engagement with the gear 64 of the rotational force transmission mechanism 60. The planet gear 70 thus engaged with the gear 64 rotates counterclockwise, and this rotation is transmitted as clockwise rotation to the gear 64, so that the gear 64 together with the input plate 61 (see FIG, 16) rotates clockwise. At this time, since little tension is applied to the purge sheet 21, rotation of the input plate 61 is transmitted to the output plate 62 and the shaft 25 fixed to the output plate 62 also rotates clockwise. Consequently, the pulled-out purge sheet 21 is rewound a little bit. Here in this embodiment, in order to apply tension to the purge sheet 21, a speed at which the purge sheet 21 is rewound due to rotation of the shaft 25 is set higher than a speed at which the purge sheet 21 is pulled out due to movement of the main carriage 22*a*. When this tension exceeds friction resistance between the input plate 61 and the output plate 62, the output plate 62 slips against the input plate 61. Therefore, the rotation of the shaft 25 is cut off, to stop the rewinding of the purge sheet 21.

When the main carriage 22*a* is located in the purge position shown in FIG. 18B, the purge sheet 21 confronts the ink ejection faces 4*a* of the heads 1, and at the same time is bent into a concave shape along its widthwise direction because the purge sheet 21 has its own internal stress and in addition its both widthwise ends are fixed to the both side faces of the sheet holder 36. Moreover, as illustrated with an alternate long and two short dashes line in FIG. 5, since the sheet holder 36 is located a little higher than the tension roller 50, the purge sheet 21 slopes down from the sheet holder 36 to the tension roller 50.

After arrangements are thus made for the purge operation, the controller 80 ejects a predetermined amount of ink through all the nozzles 8 of the heads 1 toward the surface of the purge sheet 21 (i.e., purge operation). Since the purge sheet 21 forms a concave shape along its widthwise direction as mentioned above, ink received on its surface moves to the widthwise center of the sheet. The surface of the purge sheet 21 has been given a water repellent treatment, and therefore most of the ink follows the slope of the purge sheet 21 and moves rightward in FIG. 18B. The ink is guided further to the widthwise center of the sheet by the ink guide blades 26*a* (see FIG. 4), and in addition scraped off the purge sheet 21 by the ink scraping blade 26*b*, to be flown into the waste ink tank 27.

Figure 18C:
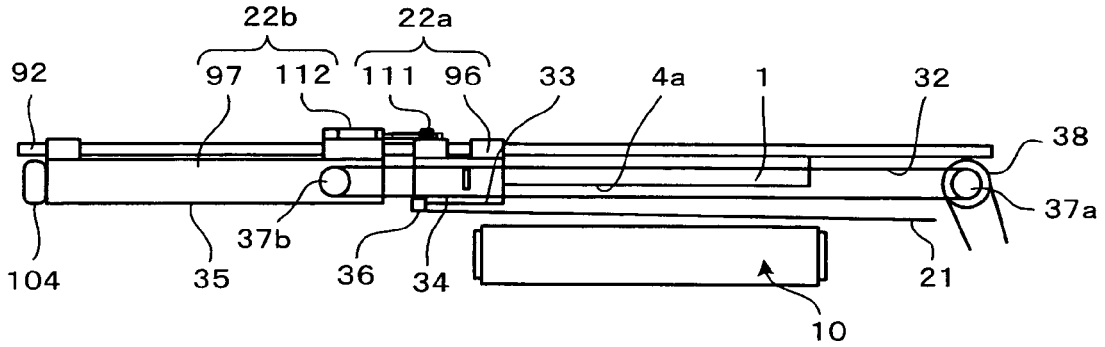

After the purge operation, the controller 80 determines to perform the ink removal operation and moves down the heads 1 into the maintenance position as shown in FIG. 18C. The maintenance position of the heads 1 corresponds to a position that, when the main carriage 22*a* is located below the ink ejection faces 4*a*, the end of each thin plate of the comb teeth 33 may be located a little lower than the ink ejection faces 4*a* and moreover the end of the wiper 34 may be in contact with the ink ejection faces 4*a* (see FIGS. 19A and 19B).

Then, the output shaft of the motor 65 (see FIG. 5) is rotated counterclockwise. This rotation is transmitted as clockwise rotation to the belt roller 37*a* as described above, so that the main carriage 22*a* moves rightward from the position shown in FIG. 18C.

In addition, when the output shaft of the motor 65 is rotated counterclockwise, this rotational force is transmitted to the shaft 25 as described above. Therefore, when the sheet holder 36 together with-the main carriage 22*a* moves rightward, the shaft 25 simultaneously rotates clockwise to rewind the purge sheet 21. This can prevent the purge sheet 21 from getting loose.

Here in this embodiment, in order to apply tension to the purge sheet 21, the speed at which the purge sheet 21 is rewound due to rotation of the shaft 25 is set higher than the speed at which the main carriage 22*a* moves. When this tension exceeds the friction resistance between the input plate 61 and the output plate 62, the output plate 62 slips against the input plate 61, thus cutting off the rotation of the shaft 25. As a result, the tension applied to the purge sheet 21 is weakened and becomes lower than the friction resistance between the input plate 61 and the output plate 62, so that the output plate 62 restarts rotating together with the input plate 61. Thereby the shaft 25 is rotated. Like this, the rotational force transmission mechanism 60 intermittently transmits rotational force to the shaft 25, so that the purge sheet 21 is always kept under predetermined tension during the movement of the main carriage 22*a* from the purge position to the parking position.

Figure 19B:
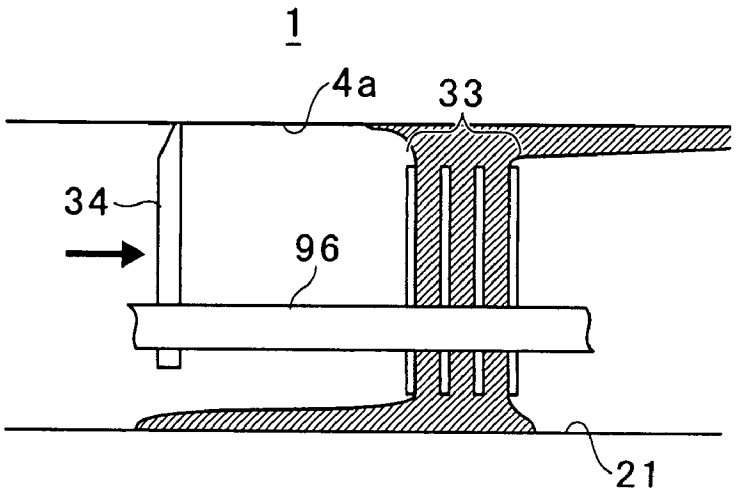
FIGS. 19A and 19B are enlarged views showing comb teeth and a wiper during the ink removal operation.
Figure 19A:
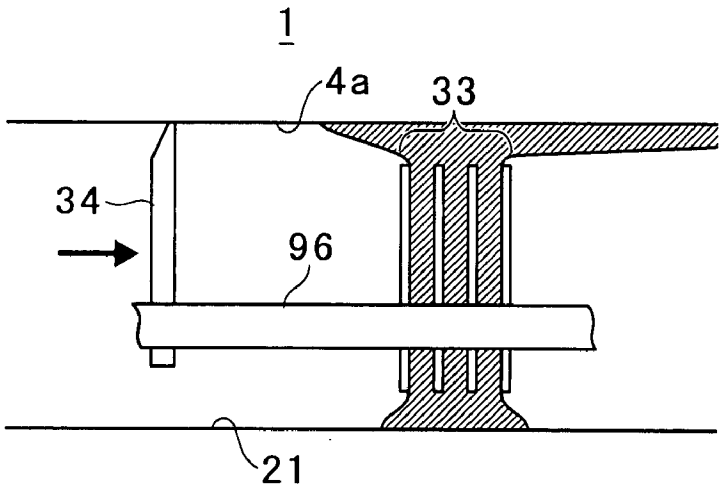

While the main carriage 22*a* is moving from the purge position to the parking position, ink adhering to the ink ejection faces 4*a* of the heads 1 is removed the comb teeth 33 and the wiper 34 that are mounted on the main carriage 22*a* (i.e., ink removal operation). To be more specific, the comb teeth 33 and the wiper 34 move relative to the ink ejection faces of the heads 1 as shown in FIGS. 19A and 19B. Accordingly, ink adhering to the ink ejection faces 4*a* is contacted by the ends of the thin plates of the comb teeth 33 to be drawn into between the thin plates due to capillary force, and furthermore wiped off by the wiper 34. At this time, the wiper 34 not only wipes off the ink but also forms proper ink meniscuses in the nozzles 8.

Figure 18D:
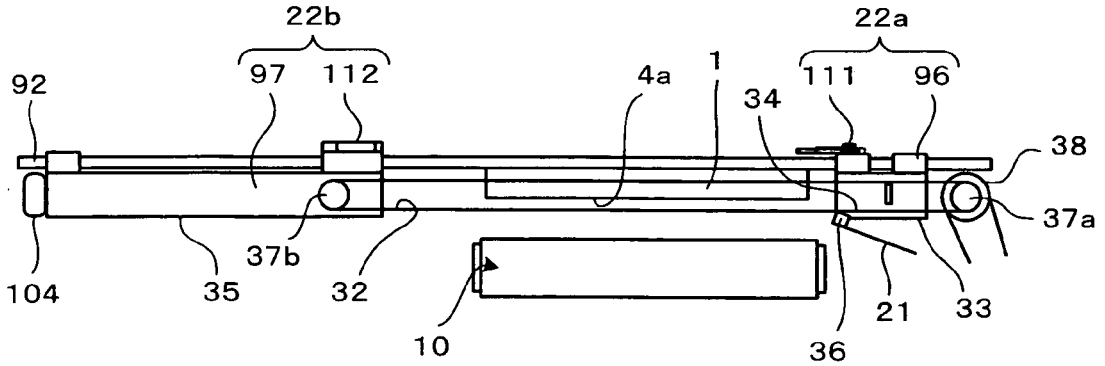

Immediately before the main carriage 22*a* returns to the parking position shown in FIG. 18D, the cylindrical member 51*a* is pushed by the abutment plate 96*a* so that the displacement arm 51 swings rightward to move down the tension bar 50. The tension applied to the purge sheet 21 is thereby increased. As a result, the ink drawn into between the thin plates of the comb teeth 33 and then dropped onto the purge sheet 21 as shown in FIGS. 19A and 19B follows the slope of the purge sheet 21 and moves to be flown into the waste ink tank 27, which is the same way as of the above-described ink ejected during the purge operation.

Next, a description will be given to how a capping as maintenance of heads 1 is performed after a printing operation. In this process, the sub carriage 22*b* is connected to the main carriage 22*a*, and moves in such a fashion as to be dragged by the main carriage 22*a*.

Figure 20A:
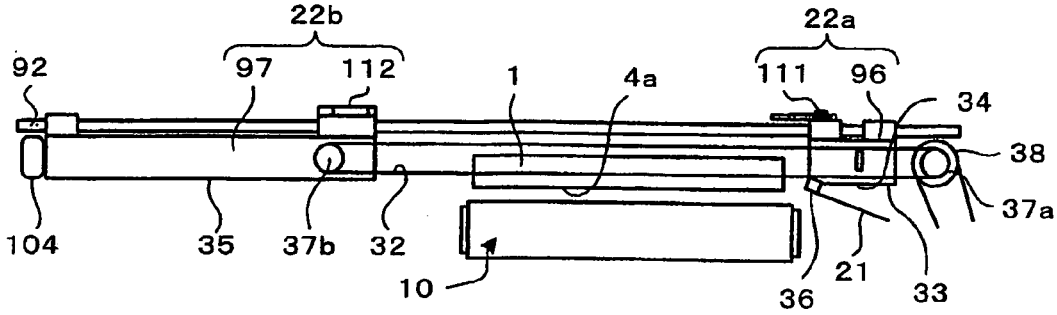
FIGS. 20A to 20D are side views showing how a capping as head maintenance is performed after a printing operation.

FIG. 20A shows a state during a printing operation. In this state, the male member 122 of the male unit 111 included in the main carriage 22*a* is located in the connection position as shown in FIG. 7.

Figure 20B:
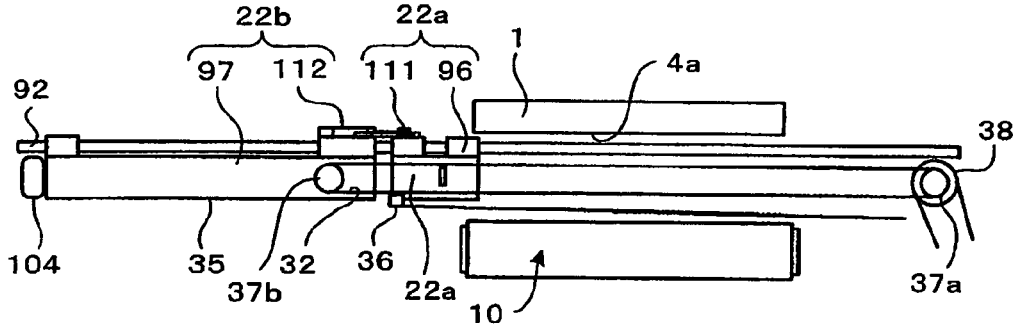

The controller 80, upon determination to perform a capping, moves up the heads 1 into the withdrawal position as shown in FIG. 20B and then moves leftward the main carriage 22*a* that has located in the parking position.

Figure 12B:
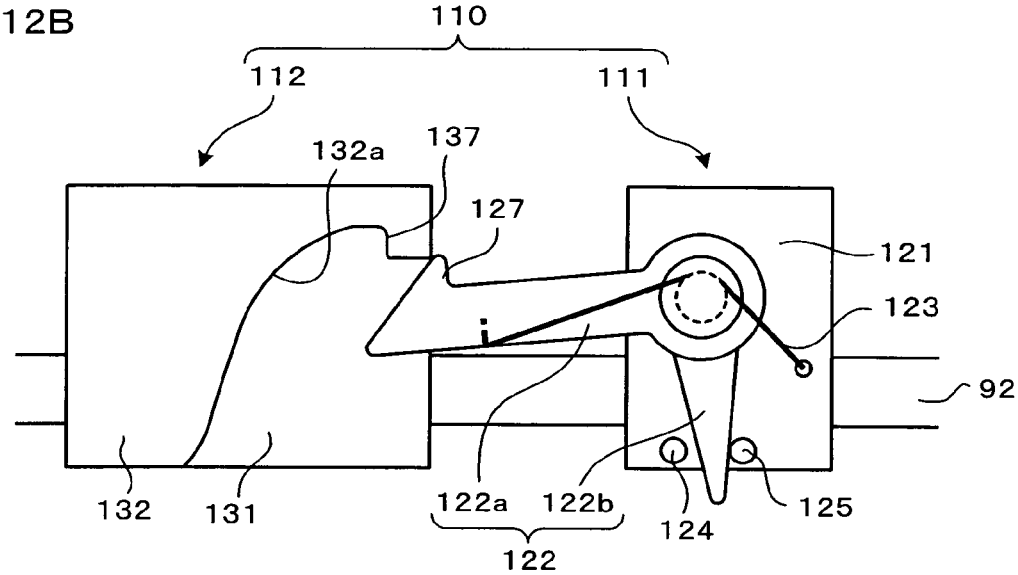
Figure 12C:
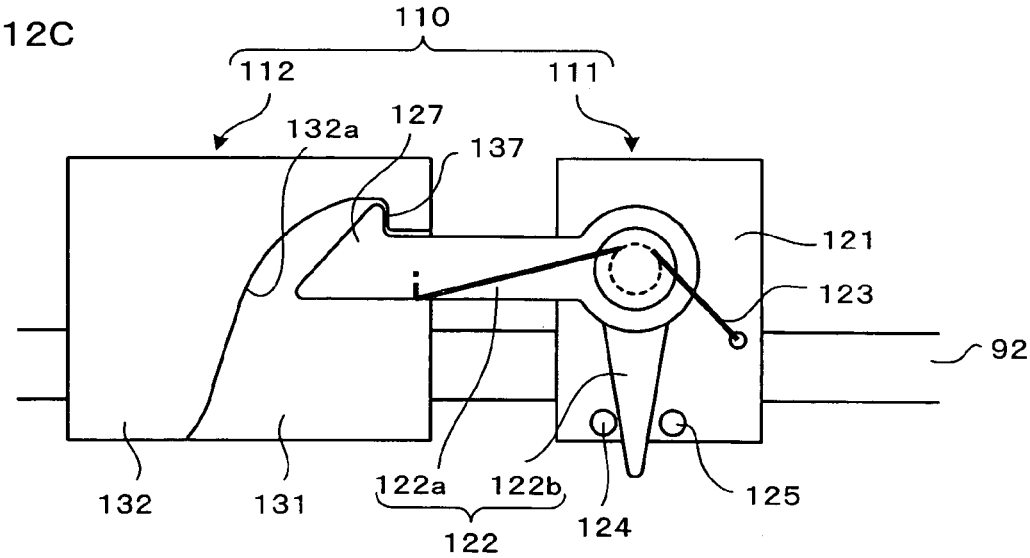
Figure 20C:
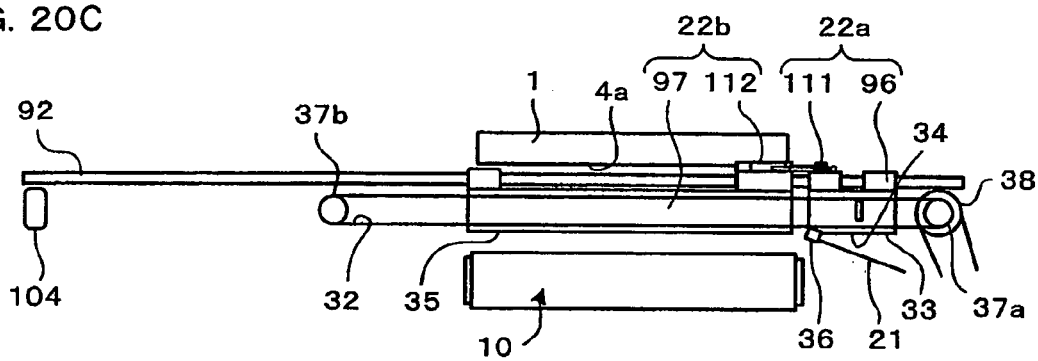

The main carriage 22*a* approaches the sub carriage 22*b*, and the male unit 111 and the female unit 112 get connected to each other as shown in FIGS. 12A to 12C. Thus, the main carriage 22*a* and the sub carriage 22*b* get connected to each other. The main carriage 22*a* and the sub carriage 22*b* thus connected are moved rightward. This movement is stopped when the main carriage 22*a* reaches a "capping position" as shown in FIG. 20C. At this timer the capping unit 35 mounted on the sub carriage 22*b* confronts the heads 1.

Figure 20D:
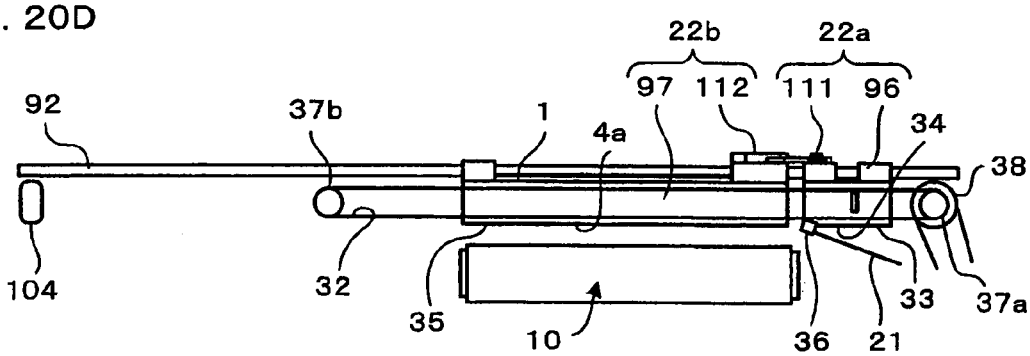

Then the controller 80 moves down the heads 1 into the printing position as shown in FIG. 20D. At this time, the ribs 35*a* (see FIG. 6) of the capping unit 35 are pressed into close contact with the outer edges of the ink ejection faces 4*a* of the respective heads 1 (i.e., capping).

Next, a description will be given to how the capping is released and further the connection between the carriages 22*a* and 22*b* is released to bring them back to their respective parking positions.

Figure 21A:
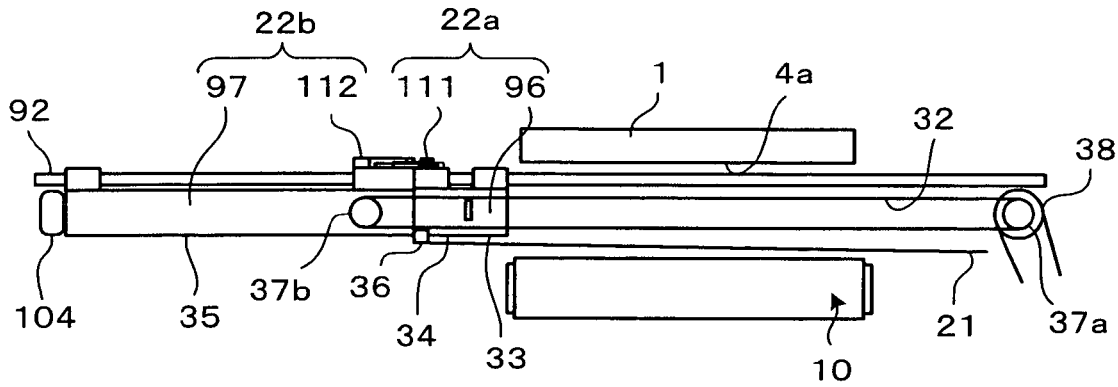
FIGS. 21A and 21B are side views showing how the capping is released and further the connection between the carriages is released to bring them back to their respective parking positions.

The controller 80, upon determination to release the capping, moves up the heads 1 from the position shown in FIG. 20D to the withdrawal position shown in FIG. 21A, and then moves leftward the main carriage 22*a*, which has located in the capping position, as kept in connection with the sub carriage 22*b*.

The sub carriage 22*b* comes into contact with the stopper 104 and stops at the parking position as shown in FIG. 21A. Then, the main carriage 22*a* is further moved leftward, so that the male member 122 of the male unit 111 is disposed in the disconnection position as shown in FIGS. 13A and 13B. Thus, the male unit 111 and the female unit 112 are separated, and the connection between the main carriage 22*a* and the sub carriage 22*b* is released.

Figure 21B:
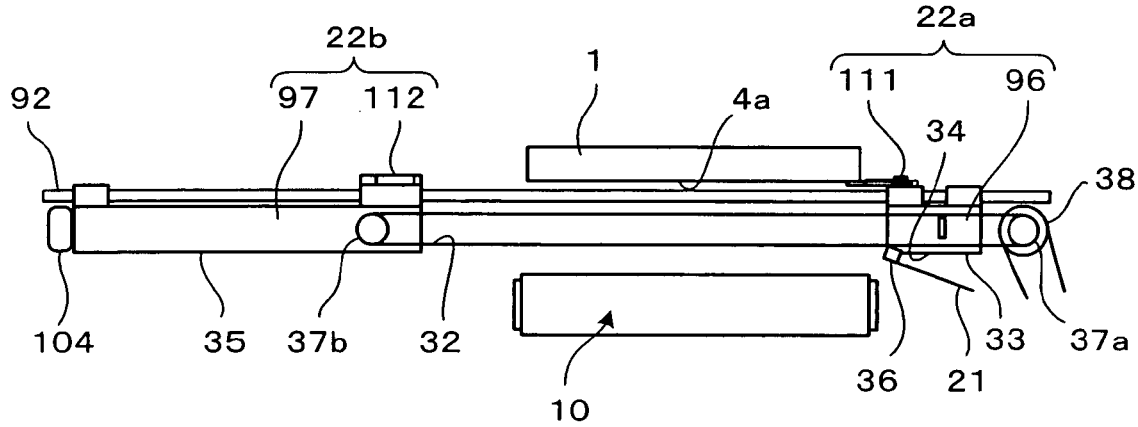

The controller 80 subsequently moves the main carriage 22*a* rightward into the parking position shown in FIG. 21B. At this time, even if the main carriage 22*a* is moved, the sub carriage 22*b* stays in its parking position because it is separated from the main carriage 22*a*.

Figure 14B:
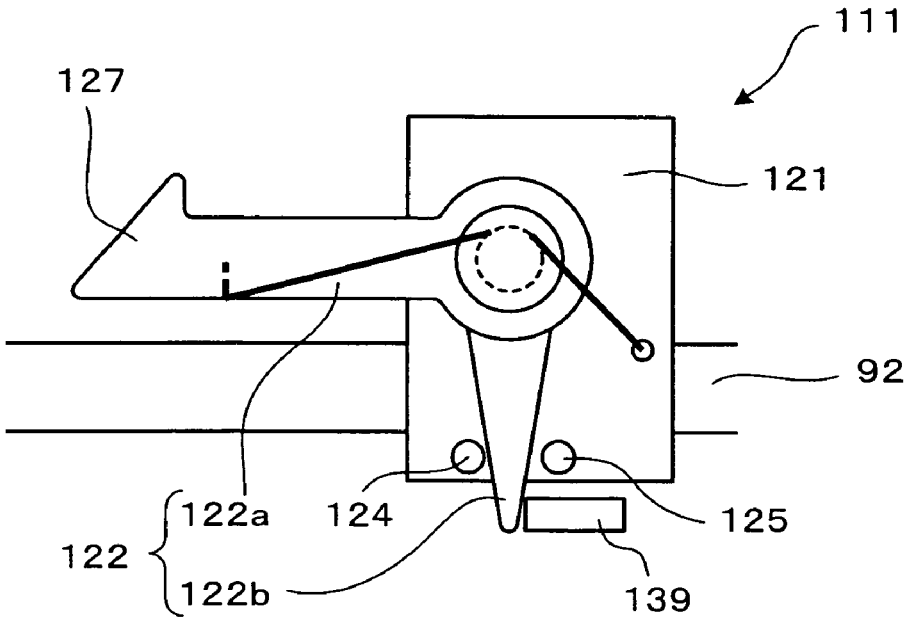

During the rightward movement of the main carriage 22*a* into the parking position, as shown in FIGS. 14A and 14B; the abutment member 139 comes into contact with the thin plate 122*b* and thereby the male member 122 rotates clockwise so that the thin plate 122*b* goes beyond the latch pin 125. Thus, the male member 122 of the male unit 111 returns to the connection position.

In the ink-jet printer 101 of this embodiment, as thus far described, the purge sheet 21, the comb teeth 33, and the wiper 34 as the maintenance members are mounted on the main carriage 22*a*, and the capping unit 35 is mounted on the sub carriage 22*b*. The main carriage 22*a* and the sub carriage 22*b* are separate from each other and reciprocally movable in the same direction. Separately disposing these carriages as shown in FIG. 18A realize space saving in the ink-jet printer 101 with respect to both directions perpendicular to and parallel to the ink ejection face 4*a*. For example, it is assumed that, as shown in FIG. 32A, widths of the main carriage 22*a* and sub carriage 22*b* are "lm" and "ls", respectively, and a width of a space required for parking and the movement of the carriages 22*a* and 22*b* is "L1", and that a distance "lo" must be kept between the end faces of the heads 1 and a maintenance member (the capping unit 35 mounted on the sub carriage 22*b* in FIG. 32A). Here, as shown in FIG. 32B, if the main carriage 22*a* is disposed at the right of the sub carriage 22*b*, a space marked with diagonal lines and having a width of "lm", i.e., a space where the main carriage 22*a* is positioned during the maintenance by the capping unit 35 mounted on the sub carriage 22*b*, must be kept in addition to the space of width "L1". If the main carriage 22*a* is disposed at the left of the sub carriage 22*b*, as shown in FIG. 32C, a space marked with diagonal lines and having a width of "ls", i.e., a space where the sub carriage 22*b* is positioned during the maintenance by the purge sheet 21, the comb teeth 33, or the wiper 34 mounted on the main carriage 22*a*, must be kept in addition to the space of width "L1". Thus, if the main and sub carriages 22*a* and 22*b* are not separate but connected and adjacent to each other, larger space is required than the case where the carriages 22*a* and 22*b* are separate from each other as the embodiment.

Further, only a single motor 65 is employed in order to move both the main carriage 22*a* and the sub carriage 22*b*. This also leads to space saving in the ink-jet printer 101.

The main carriage 22*a* and the sub carriage 22*b* can be connected and disconnected by the connection/disconnection mechanism (see FIGS. 12A to 12C and. FIGS. 13A to 13C), and driving force of the motor 65 is transmitted to the main carriage 22*a* alone (see FIG. 5). As a result, a mechanism for moving the carriages 22*a* and 22*b* can be simplified in structure and at the same time manufacture costs can be reduced.

There is provided the guide bar 92 that extends along a movement direction of the carriages 22*a* and 22*b* and supports the carriages 22*a* and 22*b* in a slidable manner. Since, like this, the two carriages 22*a* and 22*b* share a member for guiding them, simplification of the structure and reduction in manufacture cost can be realized.

The connection/disconnection mechanism 110 comprises a combination of the male unit 111 provided on the main carriage 22*a* and the female unit 112 provided on the sub carriage 22*b*. The carriages 22*a* and 22*b* can be connected to each other by engaging the protrusion 127 of the male unit 111 and the engagement portion 137 of the female unit 112 with each other, and the carriages 22*a* and 22*b* can be disconnected by releasing the aforesaid engagement. Since such a construction is employed in order to carry out connection and disconnection between carriages 22*a* and 22*b*, simplification of the structure and reduction in manufacture cost can be realized.

Once the male member 122 of the male unit 111 reaches the disconnection position, the latch pin 125 restricts the male member 122 from returning to the connection position (see FIGS. 13B and 13C). The abutment member 139 (see FIG. 14A) for releasing this restriction is provided near the guide bar 92. As illustrated in FIGS. 21A and 21B, during the movement of the main carriage 22*a* the abutment member 139 comes into contact with the thin plate 122*b* which thereby goes beyond the latch pin 125. Thus, the restriction given by the latch pin 125 is released and the male member 122 returns to the connection position. Accordingly, by a simple structure and a simple controlling, the male member 122 can return from the disconnection position to the connection position depending on the position of the main carriage 22*a*.

The purge sheet 21, the comb teeth 33, and the wiper 34 are mounted on the main carriage 22*a*, and separately the capping unit 35 is mounted on the sub carriage 22*b*. Only the main carriage 22*a* is moved in order to perform the purge operation and the ink removal operation, and the sub carriage 22*b* is connected to the main carriage 22*a* and in this condition is moved in order to perform the capping. This improves efficiency of the maintenance.

Since the parking positions of the main carriage 22*a* and the sub carriage 22*b* are located on the respective sides of the heads 1 (See FIG. 32A), space for parking both carriages and for the movement of the carriages in head maintenance can be reduced as compared with a case where the parking positions of these carriages are located on one side of the heads (see FIGS. 32B and 32C), as described above. Therefore, the ink-jet printer 101 can be surely downsized.

Figure 22:
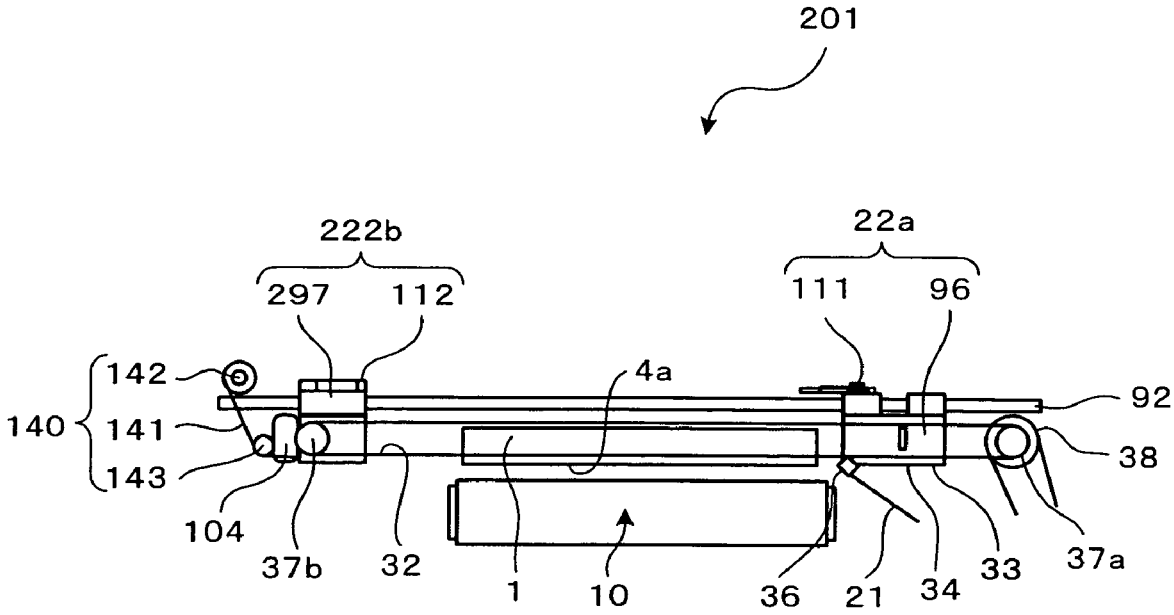
FIG. 22 is a side view of an ink-jet printer according to a second embodiment of the present invention, as seen from its front side.
Figure 23:
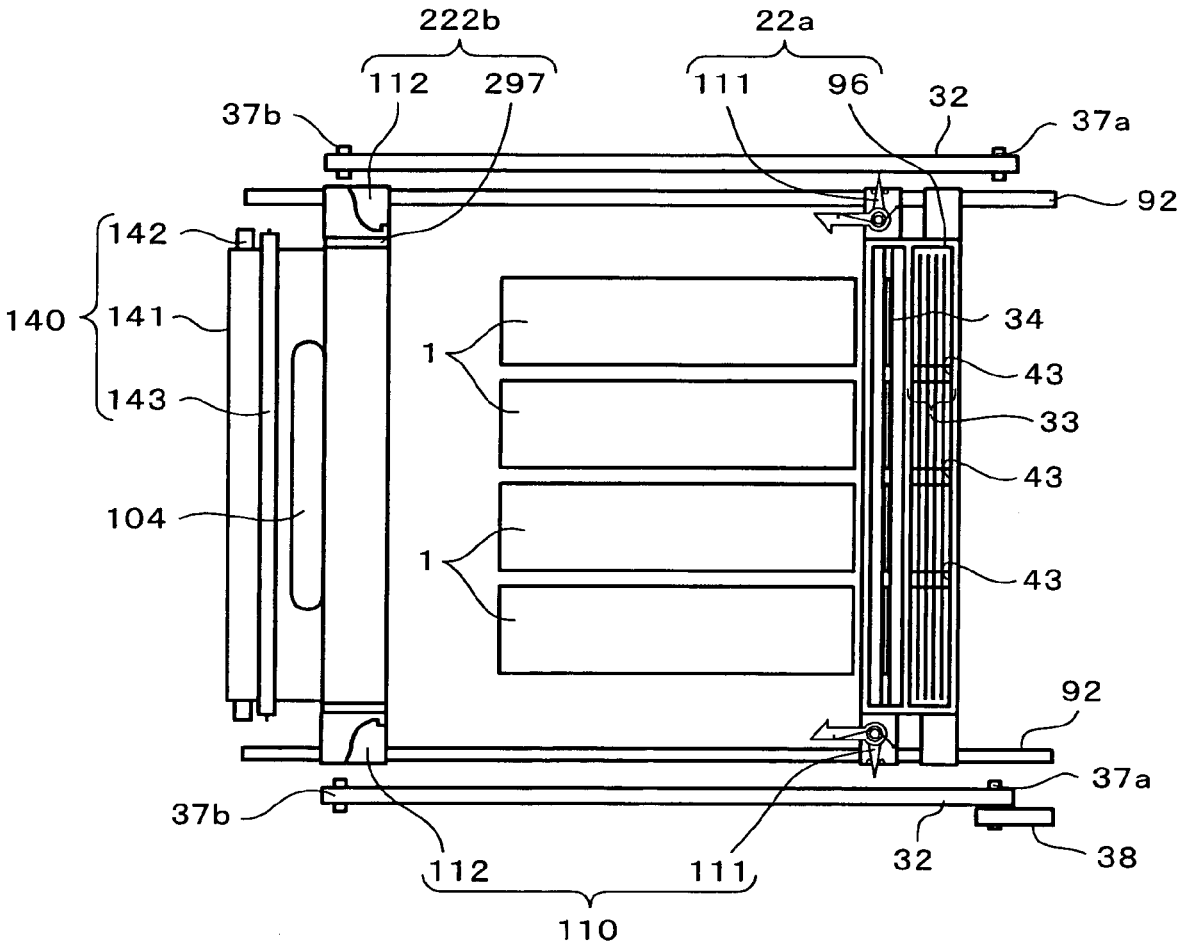
FIG. 23 is a top view of the ink-jet printer of FIG. 22.

Then, a second embodiment of the present invention will be described with reference to FIGS. 22 and 23. An ink-jet printer of this embodiment differs from that of the first embodiment only in its sub carriage. Hereinafter, the same members as those of the first embodiment will be indicated by the common reference numerals and will not be described.

In an ink-jet printer 201 of this embodiment, maintenance members are a purge sheet 21, comb teeth 33, a wiper 34, and a shutter 140. The purge sheet 21, the comb teeth 33, and the wiper 34 are mounted on a main carriage 22*a*, and the shutter 140 is mounted on a sub carriage 22*b*. That is, the sub carriage 22*b* of the first embodiment supports the capping unit 35, whereas the sub carriage 222*b* of this embodiment supports the shutter 140 instead of the capping unit 35.

Head maintenance employed in this embodiment includes a "purge operation" and an "ink removal operation" which are the same of those in the first embodiment, and also includes a "shutter operation" instead of the "capping".

The shutter 140 has a shatter sheet 141, a shaft 142, and an ink removal roller 143. The shutter sheet 141 is a long, flexible sheet, and disposed in confrontation with the ink ejection faces 4*a* which are thereby protected from a hand of a user, etc. One longitudinal end portion of the shutter sheet 141 is fixed to a carriage frame 297 of the sub carriage 222*b*, and the other end portion thereof is wound around the shaft 142. The shaft 142 extends in the widthwise direction of the head 1, and is always biased to rotate in such a direction as to wind up the shutter sheet 141. The ink removal roller 143, which is a roller covered with an ink-absorptive material, is disposed in parallel with the shaft 142 with its outer face being in contact with a surface of the shutter sheet 141 (i.e., a right-side face of the shutter sheet 141 in FIG. 22).

The sub carriage 222*b* includes a carriage frame 297 and two female units 112. With respect to the longitudinal direction of the head 1, the carriage frame 297 is shorter than the carriage frame 97 of the first embodiment. The two female units 112 are, similarly to in the first embodiment, disposed on both sides of the carriage frame 297. One longitudinal end of the shutter sheet 141 is fixed to an undersurface of a baseplate of the carriage frame 297.

Next, with reference to FIGS. 24A, 24B, and 24C, a description will be given to how a shutter operation as maintenance of heads 1 is performed after a printing operation. In this process, the sub carriage 222*b* is connected to the main carriage 22*a*, and moves in such a fashion as to be dragged by the main carriage 22*a*.

Figure 24A:
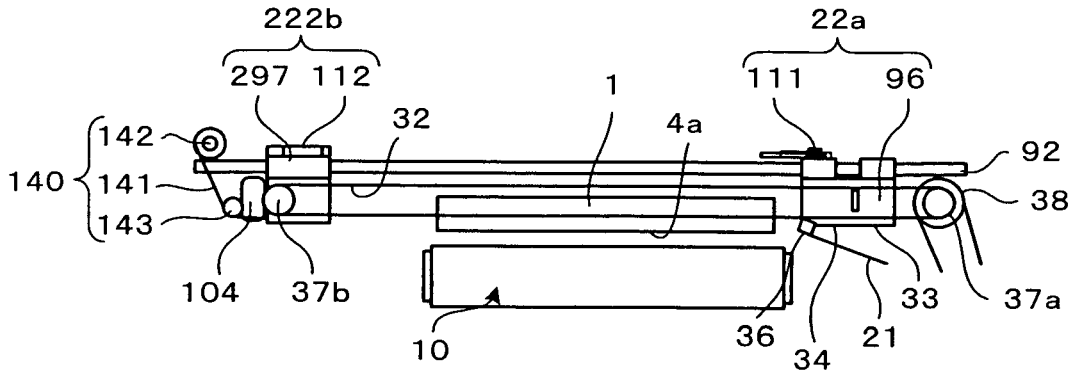
FIGS. 24A to 24C are side views showing how each part operates during a shutter operation.

FIG. 24A shows a state during a printing operation. In this state, the heads 1 are located in the printing position, and the carriages 22*a* and 222*b* are located in their parking positions. The parking position of the sub carriage 222*b* is, similarly to that of the sub carriage 22*b* of the first embodiment, a position adjacent to a stopper 104 provided on a left side of the heads 1.

Figure 24B:
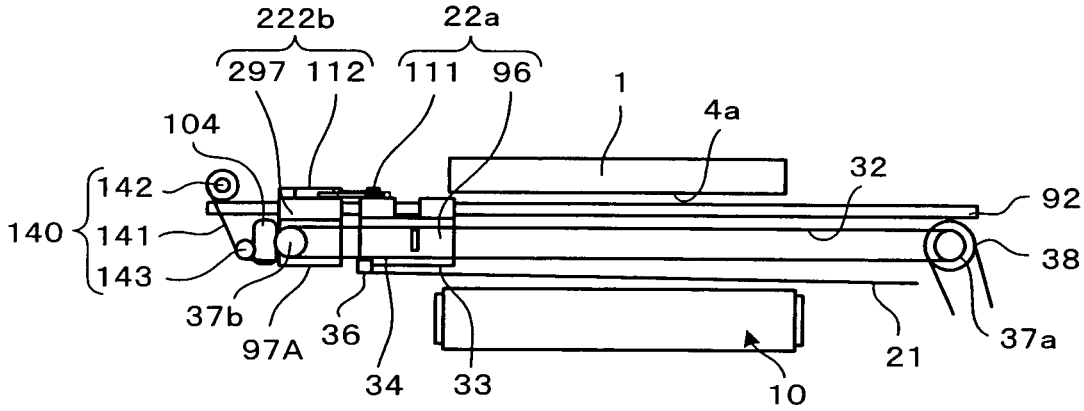
Figure 24C:
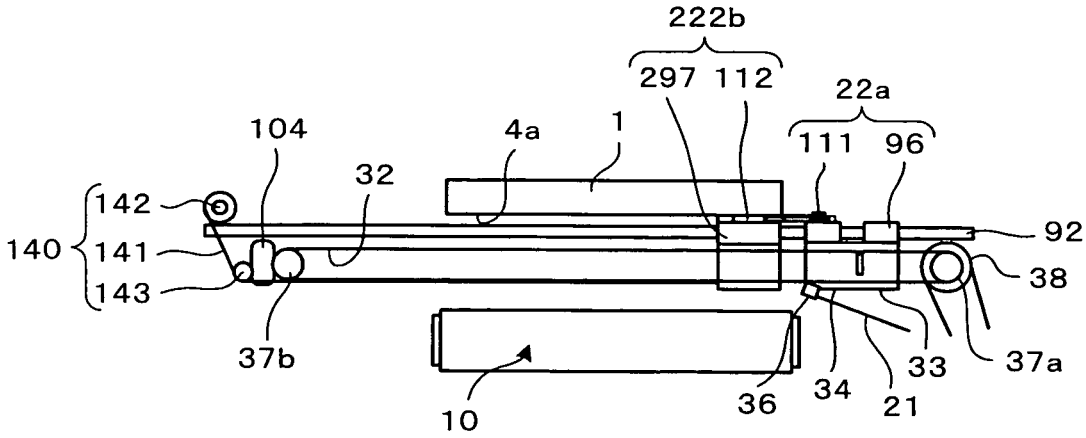

The controller 80 (see FIG. 1), upon determination to perform a shutter operation, moves up the heads 1 into the withdrawal position as shown in FIG. 24B and then moves leftward the main carriage 22*a* that has located in the parking position. The male unit 111 of the main carriage 22*a* and the female unit 112 of the sub carriage 222*b* get connected to each other as shown in FIGS. 12A to 12C. Thus, the main carriage 22*a* and the sub carriage 222*b* get connected to each other.

Then, the main carriage 22*a* and the sub carriage 222*b* thus connected are moved rightward. At this time, as shown in FIG. 24C, the shutter sheet 141 of the shutter 140 mounted on the sub carriage 222*b* is unwound from the shaft 142 and pulled out rightward. Since the shutter sheet 141 is disposed in confrontation with the ink ejection faces 4*a*, the ink ejection faces 4*a* are protected from a hand of a user, etc. (i.e., shutter operation).

Next, a description will be given to how the shutter operation is released and further the connection between the carriages 22*a* and 222*b* is released to bring them back to their respective parking positions.

The controller 80, upon determination to release the shutter operation, moves the main carriage 22*a* leftward, The sub carriage 222*b* connected to the main carriage 22*a* also moves leftward, so that the pulled-out shutter sheet 141 is rewound around the shaft 142. At this time, ink adhering to the surface of the shutter sheet 141 is absorbed into the ink removal roller 143 and thereby removed.

The sub carriage 222*b* comes into contact with the stopper 104, and stops at the parking position as shown in FIGS. 24A and 24B. Then, the main carriage 22*a* is further moved leftward, so that the male member 122 of the male unit 111 is disposed in the disconnection position as shown in FIGS. 13A and 13B. Thus, the male unit 111 and the female unit 112 are separated, that is, the main carriage 22*a* and the sub carriage 222*b* are disconnected. After the main carriage 22*a* and the sub carriage 222*b* are disconnected in this way, the main carriage 22*a* moves rightward into the parking position as shown in FIG. 24A.

In the ink-jet printer 201 of this embodiment, as thus far described, the purge sheet 21, the comb teeth 33, and the wiper 34 are mounted on the main carriage 22*a*, and separately the shutter sheet 141 is mounted on the sub carriage 222*b* only the main carriage 22*a* is moved in order to perform the purge operation and the ink removal operation, and the sub carriage 222*b* is connected to the main carriage 22*a* and in this condition is moved in order to perform the shutter operation. This improves efficiency of the maintenance.

Then, a third embodiment of the present invention will be described. An ink-jet printer of this embodiment differs from that of the first embodiment only in paper conveyance mechanism and in mechanism for maintenance. Hereinafter, the same members as those of the first embodiment will be indicated by the common reference numerals and will not be described.

Figure 26:
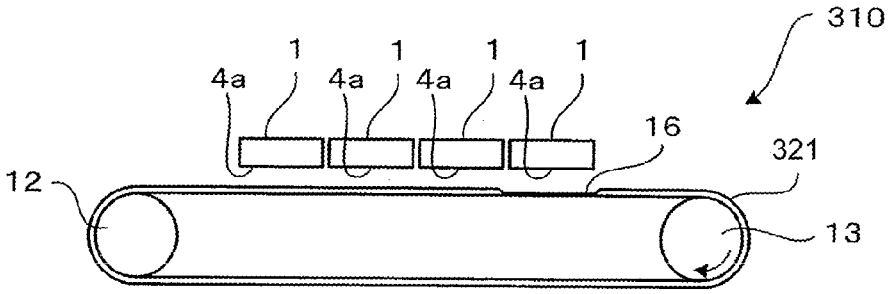
FIG. 26 schematically illustrates a paper conveyance mechanism of the ink-jet printer of FIG. 25.

In an ink-jet printer 301 of the present invention, as shown in FIG. 26, a paper conveyance mechanism 310 is substantially the same as the paper conveyance mechanism 10 of the first embodiment (see FIG. 1), but differs therefrom in that a conveyor belt 321 has, in one part thereof with respect to its longitudinal direction, a recess 16 that extends throughout a width of the conveyor belt 321. The recess 16 covers substantially the same range as the width of one head 1, and is disposed such that, during a flushing operation, it may confront the ink ejection face 4*a* of any one of the heads 1 in order to receive ink ejected from the ink ejection face 4*a*. Here the "flushing operation" means ejecting a small amount of ink left within the nozzles 8 before ejecting ink to a paper. The conveyor belt 321 travels to bring the recess 16 into confrontation sequentially with the ink ejection faces 4*a* of the four heads 1, and thereby all the heads 1 are subjected to the flushing operation.

Head maintenance employed in this embodiment includes a "purge operation", an "ink removal operation", and a "capping" which are the same as those in the first embodiment, and also includes the above-described "flushing operation".

Figure 25:
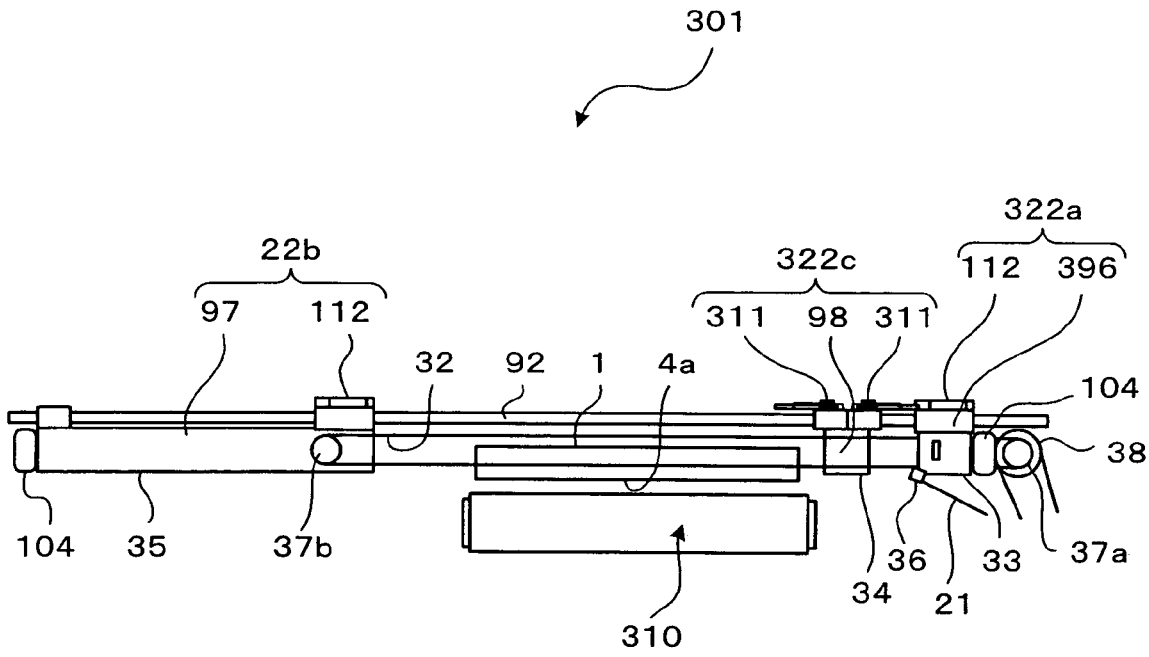
FIG. 25 is a side view of an ink-jet printer according to a third embodiment of the present invention, as seen from its front side.
Figure 27:
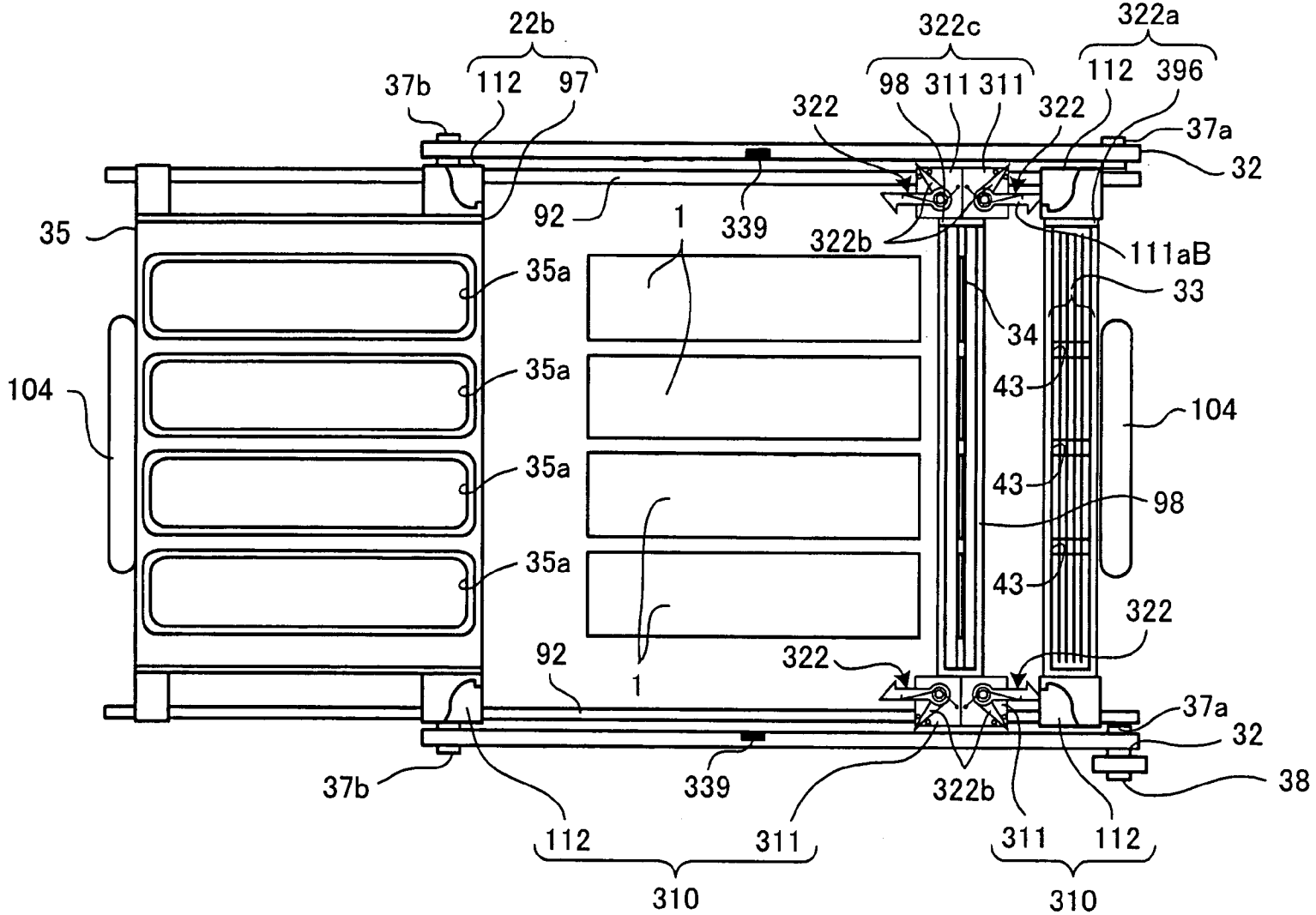
FIG. 27 is a top view of the ink-jet printer of FIG. 25.

In the ink-jet printer 301, as shown in FIGS. 25 and 27, maintenance members are the same as those of the first embodiment, i.e., a purge sheet 21, comb teeth 33, a wiper 34, and a capping unit 35. The capping unit 35 is supported on a sub carriage 22*b* similarly to the first embodiment. However, the three members of the purge sheet 21, the comb teeth 33, and the wiper 34 are not supported on the same carriage. That is, the purge sheet 21 and the comb teeth 33 are supported on a main carriage 322*a*, and the wiper 34 is supported on a drive carriage 322*c*.

Similarly to in the first embodiment, parking positions of the main carriage 322*a*and the sub carriage 22*b* arc located on right and left sides of the printer. A parking position of the drive carriage 322*c* is located between the heads of the main carriage 322*a*. In this embodiment, a driving force of a motor 65 (see FIG. 1) is transmitted not to the main carriage 322*a* but to the drive carriage 322*c*. The main carriage 322*a* and the sub carriage 22*b* are connected to the drive carriage 322*c*, and move in such a fashion as to be dragged by the drive carriage 322*c*.

The main carriage 322*a* includes a carriage frame 396 and two female units 112. With respect to the longitudinal direction of the head 1, the carriage frame 396 is shorter than the carriage frame 96 of the first embodiment. The two female units 112 are disposed on both sides of the carriage frame 396. The comb teeth 33 stand on a top surface of a baseplate of the carriage frame 396. One longitudinal end of the purge sheet 21 is fixed to a sheet holder 36 which is attached to an undersurface of the baseplate of the carriage frame 396. An abutment plate 96*a* is provided on a side face of the carriage frame 396. A stopper 304, which is the same as the stopper 104 provided on a left side of the sub carriage 22*b*, is provided on a right side of the main carriage 322*a* so that the main carriage 322*a* is restricted from moving rightward.

The drive carriage 322*c* includes a carriage frame 98 having substantially the same shape as that of the carriage frame 396, and four male units 311. The wiper 34 stands on a top surface of a baseplate of the carriage frame 98. Among the four male units 311, two are disposed on one side of the carriage frame 98, and two are disposed on the other side of the carriage frame 98. A pair of male units 311 disposed rightside to confront the main carriage 322*a* can be connected to and disconnected from the female units 112 of the main carriage 322*a*. A pair of male units 311 disposed leftside to confront the sub carriage 22*b* can be connected to and disconnected from the female units 112 of the sub carriage 22*b*. Thus, in this embodiment, a connection/disconnection mechanism 310 is constructed as a combination of the male units 311 and the female units 112.

The male unit 311 is a little different from the male unit 111 of the first embodiment in that two thin plates of a male member 322 form an acute angle instead of a right angle. In this embodiment, an abutment member 339, which is the same as the abutment member 139 shown in FIG. 14A, is disposed near the guide bar 92 between the parking position of the sub carriage 22*b* and the parking position of the drive carriage 322*c*. The male member 322 of the male unit 311 is not in contact with the abutment member 339 when it is in a connection position as shown in FIG. 27. The male member 322 is in contact with the abutment member 339 only when it is in a disconnection position. More specifically, a thin plate 322*b* of the male member 322 comes into contact with the abutment member 339, thereby returning the male member 322 to the connection position.

Next, with reference to FIGS. 28A to 28D, a description will be given to how a purge operation and an ink removal operation as maintenance of heads 1 are performed after a printing operation. In this process, the sub carriage 22*b* stays stopping at the parking position without connecting to the drive carriage 322*c*, whereas the main carriage 322*a* is connected to the drive carriage 322*c* and moves in such a fashion as to be dragged by the drive carriage 322*c*.

Figure 28A:
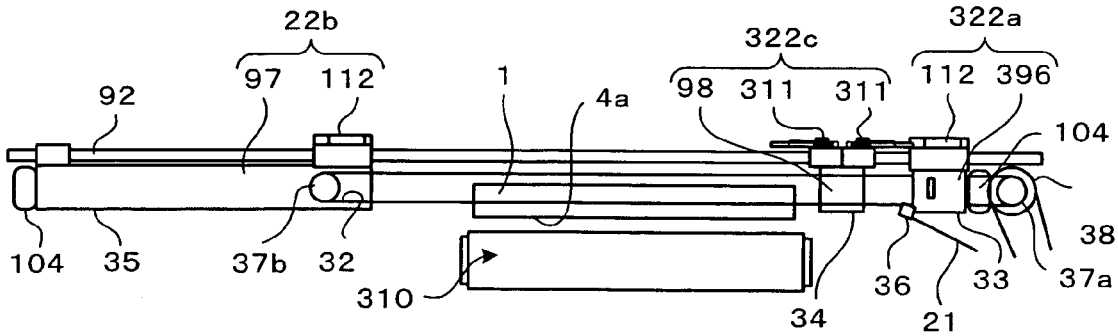
FIGS. 28A to 28D are side views showing how, in the ink-jet printer of FIG. 25, a purge operation and an ink removal operation as head maintenance are performed after a printing operation.

FIG. 28A shows a state during a printing operation. At this time, the drive carriage 322*c* is located adjacent to the main carriage 322*a*, but is not connected to the main carriage 322*a*.

Figure 28B:
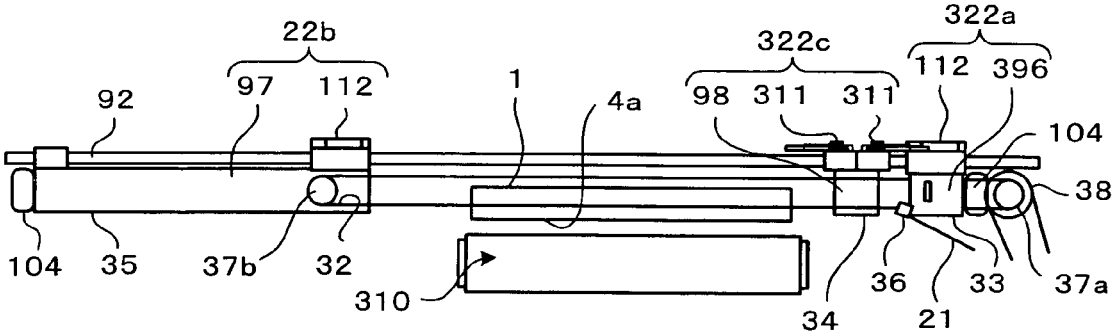

A controller 80 (see FIG. 1), upon determination to perform a purge operation, moves the drive carriage 322*c* rightward from the parking position, so that the male units 311 and the female units 112 are connected to each other to thereby connect the drive carriage 322*c* and the main carriage 322*a* (see FIG. 28B).

Figure 28C:
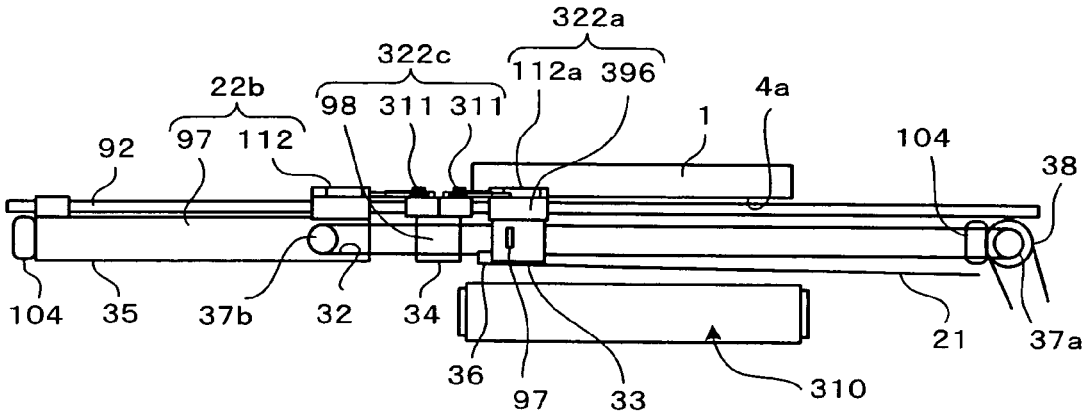

The heads 1 are moved up into the withdrawal position as shown in FIG. 28C, and then the main carriage 322*a* and the drive carriage 322*c* thus connected are moved leftward. As a result, the purge sheet 21 having its one end fixed to the main carriage 322*a* is pulled out, to confront the ink ejection faces 4*a*.

The drive carriage 322*c* reaches a position adjacent to the sub carriage 22*b* (which means a position on a slightly left side of the purge position shown in FIG. 28C, where the male unit 311 of the drive carriage 322*c* and the female unit 112 of the sub carriage are adjacent but not in connection with each other), the controller 80 stops and moves the drive carriage 322*c*: slightly rightward and then stops it in the purge position as shown in FIG. 28C. Due to this movement, tension is applied to the purge sheet 21, as described above with reference to FIG. 18B. After arrangements are thus made for the purge operation, the controller 80 ejects a predetermined amount of ink through all the nozzles 8 of the heads 1 toward the surface of the purge sheet 21 (i.e., purge operation).

Figure 28D:
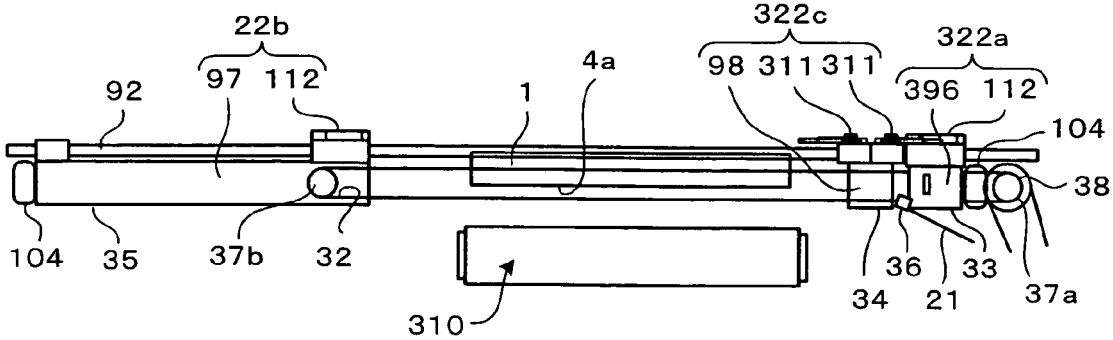

After the purge operation, the controller 80 performs the ink removal operation and moves down the heads 1 into the maintenance position as shown in FIG. 28D. Then, the drive carriage 322*c* is, together with the main carriage 322*a*, moved rightward. During this movement, ink is removed from the ink ejection faces 4*a* by comb teeth 33 mounted on the main carriage 22*a* and a wiper 34 mounted on the drive carriage 322*c* (i.e., ink removal operation).

The main carriage 322*a* comes into contact with the stopper 104 and stops at the parking position as shown in FIG. 28D. Then, the drive carriage 322*c* is further moved rightward, so that the male member 322 of the male unit 311 is disposed in the disconnection position, which is substantially similar to the case shown in FIGS. 13A and 13B. Thus, the male unit 311 and the female unit 112 are separated, and the main carriage 322*a* and the drive carriage 322*c* are disconnected.

Next, a description will be given to how a capping as maintenance of heads 1 is performed after a printing operation. In this process, the main carriage 322*a* stays still at the parking position without connection with the drive carriage 322*c*, whereas the sub carriage 22*b* is connected to the drive carriage 322*c* and moves in such a fashion as to be dragged by the drive carriage 322*c*.

Figure 29A:
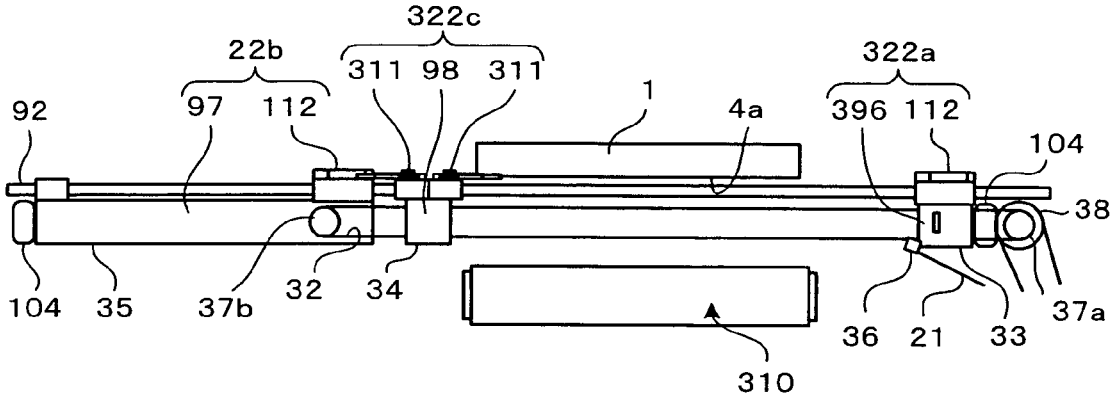
FIGS. 29A to 29C are side views showing how, in the ink-jet printer of FIG. 25, a capping as head maintenance is performed after a printing operation.

A controller 80, upon determination to perform a capping, moves up the heads 1 from the printing position into the withdrawal position as shown in FIG. 29A and then moves leftward the drive carriage 322*c* that has located in the parking position. Then, the male units 311 of the drive carriage 322*c* and the female units 112 of the sub carriage 22*b* get connected to each other, which is substantially the same as shown in FIGS. 12A to 12C. Thus, the drive carriage 322*c* and the sub carriage 22*b* get connected to each other.

Figure 29B:
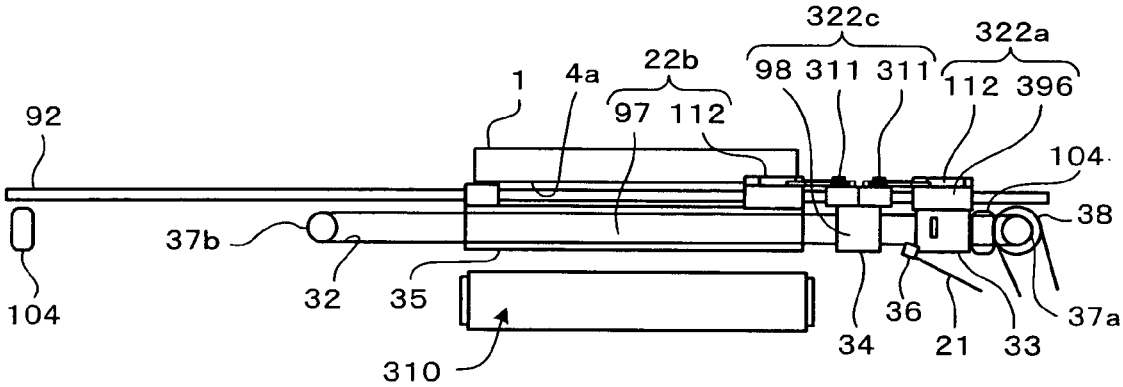

The drive carriage 322*c* and the sub carriage 22*b* thus connected are moved rightward. This movement is stopped when the drive carriage 322*c* reaches a "capping position" as shown in FIG. 29B. At this time, the capping unit 35 mounted on the sub carriage 22*b* confronts the heads 1.

Figure 29C:
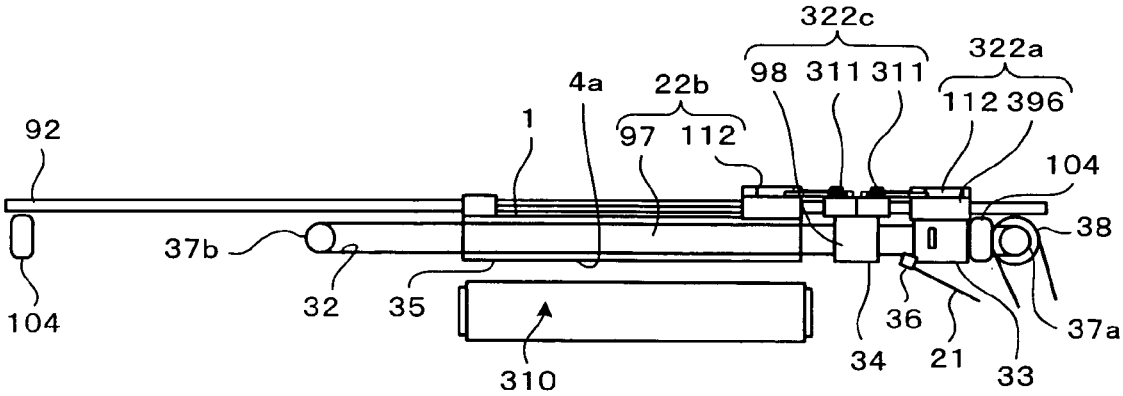

Then the controller 80 moves down the heads 1 into the printing position as shown in FIG. 29C. At this time, the ribs 35*a* (see FIG. 6) of the capping unit 35 are pressed into close contact with the outer edges of the ink ejection faces 4*a* of the respective heads 1 (i.e., capping).

Next, a description will be given to how the capping is released and further how the connection between the carriages 322*c* and 22*b* is released to bring them back to their respective parking positions.

Figure 30A:
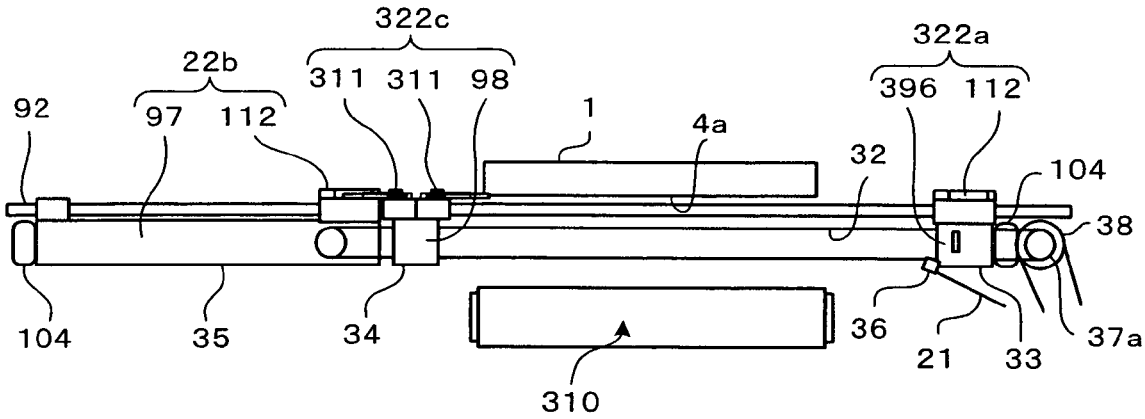
FIGS. 30A and 30B are side views showing how, in the ink-jet printer of FIG. 25, the capping is released and further the connection between the carriage is released to bring them back to their respective parking positions.

The controller 80, upon determination to release the capping, moves up the heads 1 from the position shown in FIG. 29D to the withdrawal position shown in FIG. 30A, and then moves leftward the drive carriage 322*c* which is located in the capping position and is kept in connection with the sub carriage 22*b*.

Then, the sub carriage 22*b* comes into contact with the stopper 104 and stops at the parking position as shown in FIG. 30A. Then, the drive carriage 322*c* is further moved leftward, so that the male members 322 of the male units 311 of the drive carriage 322*c* are disposed in the disconnection position. Thus, the male unit 311 and the female unit 112 are separated, and the connection between the drive carriage 322*c* and the sub carriage 22*b* is released.

Figure 30B:
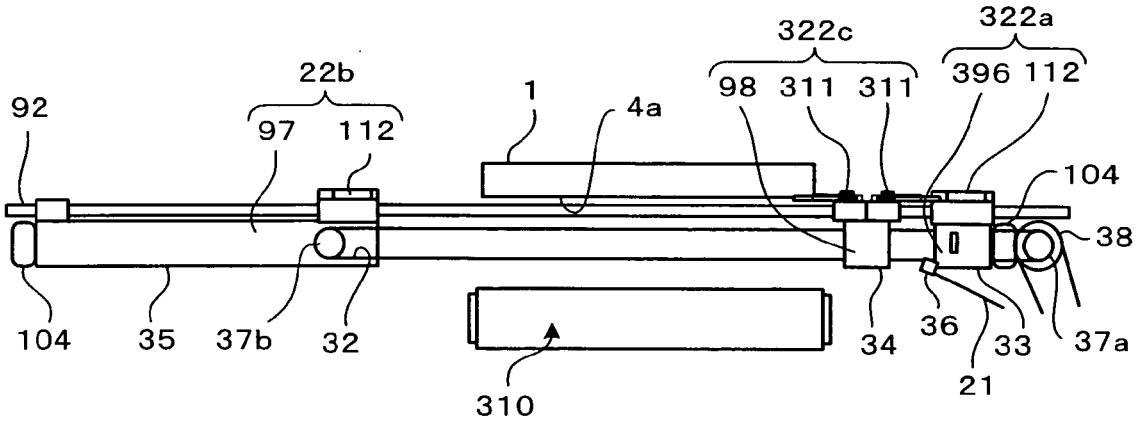

The controller 80 subsequently moves the drive carriage 322*c* rightward into the parking position shown in FIG. 30B. At this time, even if the drive carriage 322*c* is moved, the sub carriage 22*b* stays in its parking position because it is separated from the drive carriage 322*c*.

During the rightward movement of the drive carriage 322*c* into the parking position, the abutment member 339 (see FIG. 27) comes into contact with the male member 322 of the male unit 311 and thereby the male member 322 returns from the disconnection position to the connection position.

Next, a description will be given to how ink adhering to the ink ejection faces of the heads is wiped off after a flushing operation. In this process, only the drive carriage 322*c* moves, and both the main carriage 322*a* and the sub carriage 22*b* stay stopping at the parking positions without connection with the drive carriage 322*c*.

Figure 31A:
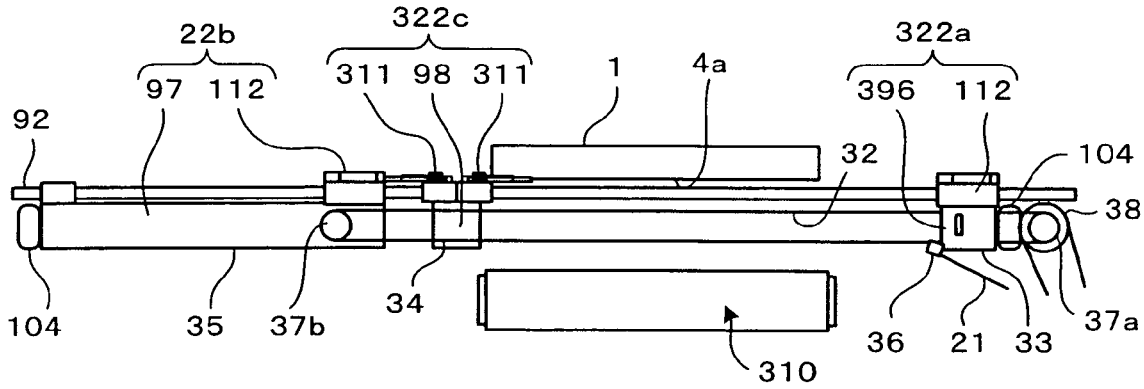
FIGS. 31A and 31C are side views showing how, in the ink-jet head of FIG. 25, ink adhering to an ink ejection face of the head is wiped off after a flushing operation.

A controller 80, upon determination that a flushing operation completes, moves up the heads 1 from the printing position shown in FIG. 28A into the withdrawal position shown in FIG. 31A. Then, the drive carriage 322*c* locating in the parking position shown in FIG. 28A is moved leftward, and stopped at a position adjacent to the sub carriage 22*b*.

Figure 31B:
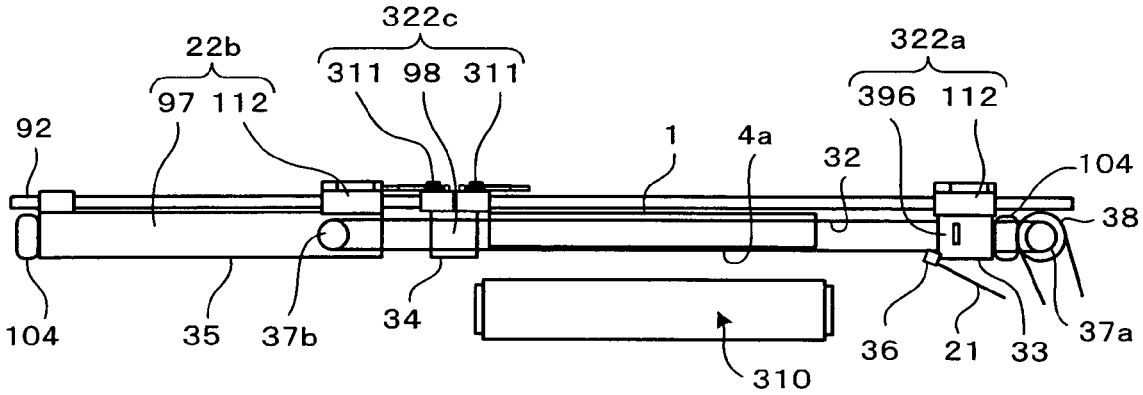
Figure 31C:
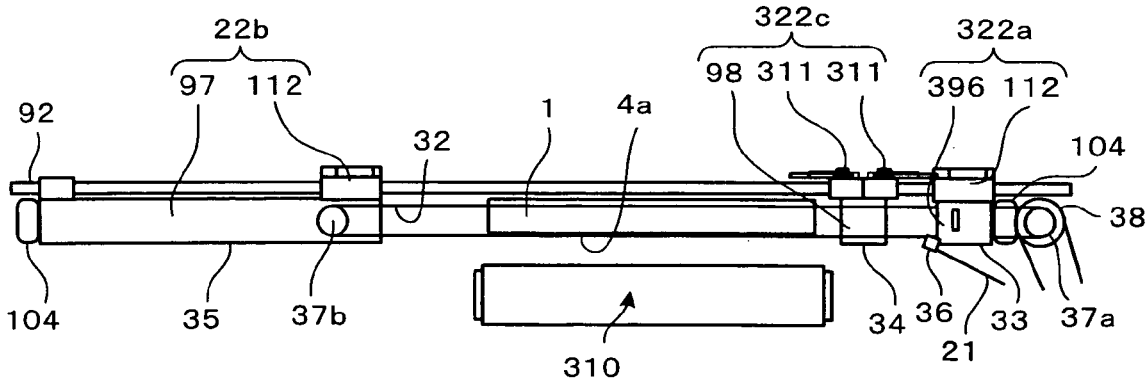

The controller 80 then moves down the heads 1 into a maintenance position shown in FIG. 31B, and then moves the drive carriage 322*c* rightward. During the movement of the drive carriage 322*c*, ink adhering to the ink ejection faces of the heads 1 is wiped off by the wiper 34 mounted on the drive carriage 322*c*. At this time, the wiper 34 not only wipes off the ink but also forms proper ink meniscuses in the nozzles 8.

While the drive carriage 322*c* is being moved, the wiper 34 wiped off ink adhering to the ink ejection faces 4 of the heads 1 and at the same time proper ink meniscuses are formed in the nozzles 8.

As thus has been described above, according to the ink-jet printer 301 of this embodiment, the purge sheet 21 and the comb teeth 33 are mounted on the main carriage 322*a*, the wiper 34 is mounted on the drive carriage 322*c*, and the capping unit 35 is mounted on the sub carriage 22*b*, separately. Only the drive carriage 322*c* and the main carriage 322*a* are moved in order to perform the purge operation and the ink removal operation, and the sub carriage 22*b* is connected to the drive carriage 322*c* and in this condition is moved in order to perform the capping. According to the ink-jet printer 301 of this embodiment, in addition, only the drive carriage 322*c* is moved in order to, after the flushing operation, wipe off ink adhering to the ink ejection faces 4 of the heads 1. This improves efficiency of the maintenance.

It suffices that at least any one of the wiper, the purge sheet, the cap, and the shutter is mounted on each of the main carriage and the sub carriage. For example, the main carriage 22*a* of the first and second embodiments may be mounted with the purge sheet 21 alone. The sub carriage 22*b* of the first embodiment may be mounted also with the shutter 140. It is also acceptable that the main carriage 22*a* is mounted with the capping unit 35 or with the capping unit 35 and the wiper 34, and the sub carriage 22*b* is mounted with the shutter 140.

The purge operation may be performed with the ink ejection faces 4*a* of the heads 1 being sealed with the capping unit 35 whose caps are each connected to a tube of a suction pump. At this time, the suction pump forcibly sucks and discharges from the nozzles 8 ink having high viscosity or containing foreign matters.

Although, in the third embodiment, the wiper 34 is mounted on the drive carriage 322*c*, the drive carriage 322*c* can be mounted with no maintenance member. In such a case, the wiper 34 can be mounted on the main carriage 322*a*.

An application of the present invention is not limited to printers, and the present invention is also applicable to ink-jet type facsimiles or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

a first carriage that is reciprocally movable only along a single axis in parallel with an ink ejection face of an ink-jet head;

a second carriage that is separate from the first carriage and reciprocally movable only along a single axis in the same direction as a movement direction of the first carriage;

and carriage-moving mechanism that selectively moves the first carriage and the second carriage, the carriage-moving mechanism including a connection/disconnection mechanism that selectively connects the first carriage to the second carriage, and disconnects the first carriage and from the second carriage, wherein:

the first carriage is mounted with at least one of a wiper that wipes off ink adhering to the ink ejection face, a sheet that receives ink ejected from the ink-jet head, a cap that seals the ink ejection face, and a shutter that is disposed to confront and protect the ink ejection face; and the second carriage is mounted with at least one of the wiper, the sheet, the carriage, and the shutter except the one(s) mounted on the first carriage.

2. The ink-jet recording apparatus according to claim 1, wherein the carriage-moving mechanism has a guide member that extends along a movement direction of the first and second carriages and supports the first and second carriage in a slidable manner.

3. The ink-jet recording apparatus according to claim 1, further comprising a single drive source that drives the carriage-moving mechanism.

4. The ink-jet recording apparatus according to claim 3, wherein the carriage-moving mechanism comprises:

a transmission mechanism that transmits driving force of the drive source to the first carriage.

5. The ink-jet recording apparatus according to claim 4, wherein the connection/disconnection mechanism includes:

a male member that has a protrusion and is attached to one of the first carriage and the second carriage;

a female member that has a recess engageable with the protrusion and is attached the other of the first carriage and the second carriage;

a restriction member that restricts a position of at least one of the male member and the female member in order to prevent engagement between the protrusion and the recess; and a release member that releases restriction on position given by the restriction member.

6. The ink-jet recording apparatus according to claim 5, wherein a state where the restriction on position is given by the restriction member and a state where the restriction on position given by the restriction member is released by the release member can be switched from one to the other depending upon a position of the first carriage.

7. The ink-jet recording apparatus according to claim 4, wherein:

the first carriage is mounted with the wiper and the sheet; and the second carriage is mounted with the cap.

8. The ink-jet recording apparatus according to claim 7, wherein, during a printing operation where ink is ejected from the ink-jet head, the first carriage and the second carriage are located in their parking positions and sandwich the ink-jet head with respect to the movement direction.

9. The ink-jet recording apparatus according to claim 8, wherein, upon a purge instruction, the carriage-moving mechanism moves the first carriage from the parking position across the ink ejection face into a purge position and at the same time renders the sheet to confront the ink ejection face, and, after a purge operation, the carriage-moving mechanism moves the first carriage from the purge position into the parking position.

10. The ink-jet recording apparatus according to claim 9, wherein, upon a capping instruction, the carriage-moving mechanism moves the first carriage from the parking position into a carriage connection position where the first carriage is closer to the second carriage than in the purge position, and at the same time connects the first and second carriages via the connection/disconnection mechanism, and subsequently the carriage-moving mechanism moves the first carriage toward the parking position across the ink ejection face into the capping position and at the same time renders the cap mounted on the second carriage to confront the ink ejection face.

11. The ink-jet recording apparatus according to claim 4, wherein:

the first carriage is mounted with the wiper and the sheet; and the second carriage is mounted with the shutter.

12. The ink-jet recording apparatus according to claim 3, further comprising a third carriage that is separate from the first and second carriages, is reciprocally movable in the same direction as the movement direction of the first and second carriages, and is located between the first carriage and the second carriage with respect to the movement direction, wherein the carriage-moving mechanism includes:

a transmission mechanism that transmits driving force of the drive source to the third carriage;

a first connection/disconnection mechanism that selectively connects and disconnects the first carriage and the third carriage; and a second connection/disconnection mechanism that selectively connects and disconnects the second carriage and the third carriage.

13. The ink-jet recording apparatus according to claim 12, wherein the carriage-moving mechanism has a guide member that extends along a movement direction of the first, second, and third carriages and supports the first, second, and third carriages in a slidable manner.

14. The ink-jet recording apparatus according to claim 12, wherein:

the first carriage is mounted with the sheet;

the second carriage is mounted with the cap; and the third carriage is mounted with the wiper.

15. The ink-jet recording apparatus according to claim 12, wherein:

the first carriage is mounted with the sheet;

the second carriage is mounted with the shutter; and the third carriage is mounted with the wiper.

16. An ink-jet recording apparatus comprising:

a first carriage that is reciprocally movable in parallel with an ink ejection face of an ink-jet head;

a second carriage that is separate from the first carriage and reciprocally movable in the same direction as a movement direction of the first carriage;

a third carriage that is separate from the first and second carriages, is reciprocally movable in the same direction as the movement direction of the first and second carriages, and is located between the first carriage and the second carriage with respect to the movement direction;

a carriage-moving mechanism that selectively moves the first carriage, the second carriage, and the third carriage; and a single drive source that drives the carriage-moving mechanism, wherein:

the first carriage is mounted with at least one of a wiper that wipes off ink adhering to the ink ejection face, a sheet that receives ink ejected from the ink-jet head, a cap that seals the ink ejection face, and a shutter that is disposed to confront and protect the ink ejection face;

the second carriage is mounted with at least one of the wiper, the sheet, the cap, and the shutter except the one(s) mounted on the first carriage;

the carriage moving mechanism includes:

a transmission mechanism that transmits driving force of the drive source to the third carriage;

a first connection/disconnection mechanism that selectively connects and disconnects the first carriage and the third carriage; and a second connection/disconnection mechanism that selectively connects and disconnects the second carriage and the third carriage, and the third carriage is configured to move with the first carriage that is connected thereto via the first connection/disconnection mechanism, to move with the second carriage that is connected thereto via the second connection/disconnection mechanism, and to move independently from the first carriage and the second carriage.

17. An ink-jet recording apparatus comprising:

a first carriage that is reciprocally movable in parallel with an ink ejection face of an ink-jet head;

a second carriage that is separate from the first carriage and reciprocally movable in the same direction as a movement direction of the first carriage;

a third carriage that is separate from the first and second carriages, is reciprocally movable in the same direction as the movement direction of the first and second carriages, and is located between the first carriage and the second carriage with respect to the movement direction;

a carriage-moving mechanism that selectively moves the first carriage, the second carriage, and the third carriage; and a single drive source that drives the carriage-moving mechanism, wherein:

the first carriage is mounted with at least one of a wiper that wipes off ink adhering to the ink ejection face, a sheet that receives ink ejected from the ink-jet head, a cap that seals the ink ejection face, and a shutter that is disposed to confront and protect the ink ejection face;

the second carriage is mounted with at least one of the wiper, the sheet, the cap, and the shutter except the one(s) mounted on the first carriage;

the carriage moving mechanism includes:

a transmission mechanism that transmits driving force of the drive source to the third carriage;

a first connection/disconnection mechanism that selectively connects the first carriage to the third carriage and disconnects the first carriage from the third carriage; and a second connection/disconnection mechanism that selectively connects the second carriage to the third carriage and disconnects the second carriage from the third carriage, and the third carriage is configured to move with the first carriage that is connected thereto via the first connection/disconnection mechanism, to move with the second carriage that is connected thereto via the second connection/disconnection mechanism, and to move independently from the first carriage and the second carriage.

* * * * *

UNITED STATES PATENT AND TRADEMARK OFFICE

CERTIFICATE OF CORRECTION

PATENT NO. : 7,517,048 B2
APPLICATION NO. : 11/138901
DATED : April 14, 2009
INVENTOR(S) : Osamu Takagi It is certified that error appears in the above-identified patent and that said Letters Patent is hereby corrected as shown below:

In Column 21, Claim 1, Line 60:
Please delete "and carriage-moving mechanism" and insert --and a carriage-moving mechanism--

Signed and Sealed this

Twenty-second Day of September, 2009

David J. Kappos

David J. Kappos
*Director of the United States Patent and Trademark Office*